US006551371B1

(12) United States Patent
Furuta et al.

(10) Patent No.: US 6,551,371 B1
(45) Date of Patent: Apr. 22, 2003

(54) TITANIUM-BASED COMPOSITE MATERIAL, METHOD FOR PRODUCING THE SAME AND ENGINE VALVE

(75) Inventors: Tadahiko Furuta, Aichi (JP); Takashi Saito, Aichi (JP); Hiroyuki Takamiya, Aichi (JP); Toshiya Yamaguchi, Toyota (JP)

(73) Assignees: Kabushiki Kaisha Toyota Chuo Kenkyusho, Aichi-gun (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/743,809

(22) PCT Filed: Jul. 19, 1999

(86) PCT No.: PCT/JP99/03885

§ 371 (c)(1),
(2), (4) Date: Jan. 22, 2001

(87) PCT Pub. No.: WO00/05425

PCT Pub. Date: Feb. 3, 2000

(30) Foreign Application Priority Data

Jul. 21, 1998 (JP) ..... 10-205526

(51) Int. Cl.[7] ..... C01C 1/05; B22F 3/00

(52) U.S. Cl. ..... 75/235; 75/236; 75/245; 75/229; 419/12; 419/13; 419/14; 419/20

(58) Field of Search ..... 75/235, 236, 245; 419/12, 13, 14, 20

(56) References Cited

U.S. PATENT DOCUMENTS

| | | | | |
|---|---|---|---|---|
| 4,639,281 A | * | 1/1987 | Sastry et al. | 148/407 |
| 4,931,253 A | * | 6/1990 | Eylon et al. | 419/25 |
| 4,968,348 A | * | 11/1990 | Abkowitz et al. | |
| 5,074,907 A | * | 12/1991 | Amato et al. | 75/235 |
| 5,409,518 A | | 4/1995 | Saito et al. | |
| 5,520,879 A | | 5/1996 | Saito et al. | |
| 6,117,204 A | | 9/2000 | Saito et al. | 75/245 |

FOREIGN PATENT DOCUMENTS

| | | |
|---|---|---|
| JP | 1-242743 | 9/1989 |
| JP | 4-501137 | 2/1992 |
| JP | 4-202729 | 7/1992 |
| JP | 4-56097 | 9/1992 |
| JP | 5-5142 | 1/1993 |
| JP | 6-179937 | 6/1994 |
| JP | 7-41882 | 2/1995 |
| JP | 2523556 | 5/1996 |
| JP | 9-165634 | 6/1997 |
| JP | 09-165634 | 6/1997 |
| JP | 10-195563 | 7/1998 |

OTHER PUBLICATIONS

T. Saito, et al., Proceedings of the Symposium on Recent Advances in Titanium Metal Matrix Composites, XP–001041262, pps. 33–44, "Development of Low Cost Titanium Matrix Composite", 1995.

T. Saito, Advanced Performance Materials, vol. 2, No. 2, XP–000884456, pps. 121–144, "A Cost–Effective P/M Titanium Matrix Composite for Automobile Use", 1995.

ASM International, Edited by R. Boyer, et al., "Materials Properties Handbook: Titanium Alloys", XP–002183783, Jun. 1994, (submitting Abstract only of Ti–5Al–5Sn–2Zr–2Mo–0.25Si, Reviewed by F. Russo, 1 page only).

M. Hagiwara, et al., Proceedings of the 1998 TMS Annual Meeting, XP–001022826, pps. 21–28, "Low Cost Synthesis of P/M Ti Alloys and Ti–Based Particulate Composites with Improved High Cycle Fatigue Strength", Feb. 1998.

M. Hagiwara, et al., Proceeding of the 1st International Symposium on Metallurgy and Technology of Practical Titanium Alloys, XP–001041261, pps. 363–370, "Properties of P/M Processed Titanium Alloy/Particulate Composites", Dec. 7, 1993.

M. Hagiwara, et al., Proceedings of the 1997 TMS Annual Meeting, XP–001022856, pps. 219–226, "Improved High Cycle Fatigue Properties of Titanium–Based Particultes Composites", Feb. 10, 1997.

Richard J. Lederich, et al., JOM, pp. 68–71, "Preparing Damage–Tolerant Titanium–Matrix Composites", Nov. 1994.

Official Communication Pursuant to Article 96(2) EPC.

* cited by examiner

*Primary Examiner*—Ngoclan Mai
(74) *Attorney, Agent, or Firm*—Oblon, Spivak, McClelland, Maier & Neustadt, P.C.

(57) ABSTRACT

A titanium-based composite material according to the present invention is characterized in that it comprises: a matrix containing a titanium (Ti) alloy as a major component, and titanium compound particles and/or rare-earth element compound particles dispersed in the matrix, wherein the matrix contains 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O), the titanium compound particles occupy 1–10% by volume, and the rare-earth element compound particles occupy 3% by volume or less.

With this arrangement, it is possible to obtain a titanium material, which is good in terms of the heat resistance, hot working property, specific strength, and so on.

48 Claims, 5 Drawing Sheets

TITANIUM-BASED COMPOSITE MATERIAL, METHOD FOR PRODUCING THE SAME AND ENGINE VALVE

TECHNICAL FIELD

The present invention relates to a titanium-based composite material, which can be utilized for high-stress component members of a variety of machines, and a process for producing the same. In particular, it relates to a titanium-based composite material, which is suitable for engine valves for automobiles, etc., which are required to exhibit heat resistance, and a process for producing the same.

BACKGROUND ART

Since titanium alloys exhibit high specific strength and good toughness, they are used in various machinery component members. For example, with the U.S.A. and the U.K. as the central figure, titanium alloys have been used mainly in the fields of military, space and aircraft. Further, in these fields, heat resistant titanium alloys exhibiting good heat resistance have been developed energetically. However, since these heat resistant titanium alloys have been developed while being emphasized on their performances, they are expensive and lack mass-producing capability. Furthermore, it is difficult to melt and form them, and their yield rates were poor. Accordingly, these titanium materials were used only in limited fields.

However, recently, as the high-performance and light-weighting requirements of machinery are increased, titanium materials, especially titanium materials which are good in terms of heat resistance, have been given attention again in general machinery fields, such as automobile, etc. As one of the examples of the titanium materials, which are good in terms of the heat resistance, an automotive engine valve is hereinafter described.

Conventionally, engine valves are disposed in inlet ports and outlet ports of an engine, and they are an important component part which determines the performance of the engine, such as the fuel consumption, the efficiency, the output, and so on. Further, the engine valves become high temperatures exceeding 600° C. In particular, the valves (exhaust valves) in the exhaust system become considerably higher temperatures than the valves (intake valves) in the intake system. For instance, even in a mass-produced engine, since the exhaust valves are subjected to a higher temperature, there may be a case where the exhaust valves become at around 800° C. Therefore, the exhaust valves are required to exhibit good heat resistance. The conventional exhaust valves for mass production have used a heat resistant steel, such as SUH35, etc., as per JIS standard.

However, when the heat resistant steel, such as SUH35, is used in a reciprocating component part, like the valve, its inertial weight increases, because the specific gravity is large. Consequently, the maximum number of the revolutions is limited, further, since it is necessary to increase the spring load, the friction enlarges, and the engine is inhibited from being high performance.

Hence, it is considered to apply a titanium material, which is good in terms of the specific strength, etc., to the engine valve. Since the titanium material is light weight, and since it is superb in terms of the mechanical properties, it is a very attractive material. When the titanium material is applied to the engine valve, it is possible to reduce the inertial weight, to make it produce a higher output, and to improve the fuel consumption. Accordingly, titanium materials have been employed earlier for engine valves for racing cars.

However, in view of the costs, the titanium materials have not been employed for mass-produced engine valves. In particular, since the conventional titanium material has a working limit temperature of about 600° C., it is difficult to employ it to the component members, like exhaust valves, which are used in elevated temperature ranges.

Next, the heat resistance of titanium materials will be investigated. Generally, the heat resistance of titanium alloys is governed by the structure. The structure is determined by the alloy composition, the processing temperature, the processing degree and the heat treatment conditions after processing. In particular, the structure is affected greatly by the processing temperature.

For example, there is a case where the heat resistance of titanium materials is enhanced by containing silicon in the titanium materials. In this case, by taking the relationship between the β transformation temperature and the solid solution temperature of a silicon compound (silicide) into consideration, it is necessary to determine the processing temperature. Specifically, in the case that the β transformation temperature is higher than the solid solution temperature of the silicide, when a titanium alloy (for example, Ti—Al—Sn—Zr—Nb—Mo—Si-based titanium alloy) is processed by hot working at a high temperature of the β transformation temperature or more, coarse acicular microstructure has been formed. This acicular microstructure is unpreferable, because it becomes the causes of the casting breakage, the deterioration of elongation and the degradation of low cycle fatigue property.

While, the processing at the β transformation temperature or less is generally difficult, because the deformation resistance is large. It is understood from this example that the processing ability decreases when it is intended to improve the heat resistance of titanium material. Accordingly, it is difficult to obtain the compatibility between the heat resistance and the processing ability.

In order to solve such assignments, and to further improve the heat resistance, etc., of titanium materials, various proposals have been made, for instance, as follows.

① Japanese Examined Patent Publication (KOKOKU) No. 4-56,097 (registered No. 1,772,182), an Al—Sn—Zr—Nb—Mo—Si-contained alloy, in which a trace amount of C is contained, is disclosed. This titanium alloy is enhanced in terms of the heat resistance, the heat treating property and the hot working property by adding a trace amount of C so that the α+β region, which is the temperature range of the heat treatment and the hot working, is enlarged.

However, in the case of this titanium alloy, the temperature (working limit temperature), at which a sufficiently high temperature tensile strength and fatigue property are obtained, is 600° C. approximately. Further, this titanium alloy is produced by melting, casting and forging, which are regarded as basic processes. Hence, the costs go up, and accordingly it is not suitable for mass-produced articles, such as automotive component parts, which are required to be low costs.

Furthermore, although the α+β region is enlarged, the solid solution temperature of the silicide is lower than the β transformation temperature. Consequently, when hot working is carried out at a temperature higher than the β transformation temperature, coarse acicular microstructures have been formed. In order to avoid this, in the publication, eventually, the processing is carried out at a temperature of the β transformation temperature or less. Therefore, although the titanium alloy forms the balanced bi-modal structure in view of the material properties, it still exhibits large processing resistance, and the hot working property is not fully improved.

② In Japanese Unexamined Patent Publication (KOKAI) No. 4-202,729, there is disclosed an Al—Sn—Zr—Nb—Mo—Si-contained alloy, in which Mo is added in an especially large amount, is disclosed. Thus, the heat resistance of the alloy is improved to about 610° C.

However, even in this case, similarly to the titanium alloy of Japanese Examined Patent Publication (KOKOKU) No. 4-56,097, the heat resistance is insufficient. In addition, the addition of Mo in a large amount is unpreferable, because it causes the deterioration of the high temperature tensile strength.

Further, a titanium alloy is disclosed which further contains at least one member selected from the group consisting of C, Y, B, rare-earth elements and S in a total amount of 1%. Thus, the heat resistance, specifically, the creep resistance is improved.

However, even in this case, a sufficient creep property can be obtained up to about 600° C. only, where the dislocation creep governs, and the heat resistance is insufficient. Especially, a sufficient creep resistance cannot be obtained in an elevated temperature range of 800° C. approximately in which the diffusion starts contributing.

Moreover, in both of the cases, melting, casting and forging used as basic processes, lead to high costs, so that they are not suitable for mass-produced component parts, and so on.

③ There is a report on a titanium-based composite material in which titanium boride whiskers are composited by using the Ingot Metallurgy Process (IM) and the Rapid Solidification Process (RS) (Preparing Damege-Tolerant Titanium-Matrix Composites, JOM, November 1994, P68).

According to this literature, it is reported that good properties in terms of the strength, rigidity and heat resistance can be obtained by this titanium-based composite material.

However, the dispersion of the titanium boride whiskers are in homogenous, and the high-cycle fatigue property at elevated temperatures is low. The high-cycle fatigue property in the high temperature range, in addition to the high temperature creep property, is an important property, required for exhaust valve materials, and the like, for an automotive engine. Accordingly, it is not a material, which is suitable for exhaust valves, etc.

Moreover, the Ingot Metallurgy Process or the Rapid Solidification Process as the basic process is used for the titanium-based composite material, the costs of this titanium-based composite material go up.

Therefore, in view of the heat resistance and the costs, it is difficult to apply this titanium-based composite material as well to mass-produced component parts, such as automotive component parts, and so on.

④ In Japanese Unexamined Patent Publication (KOKAI) No. 5-5,142, a titanium-based composite material is disclosed which is made of a matrix, being composed of α-type, α-type+β-type and β-type titanium alloys, and 5–50% by volume of a titanium boride solid solution. The titanium boride solid solution, which is essentially less likely to react with the titanium alloy, is selected as reinforcing particles, thereby improving the strength, the rigidity, the fatigue property, the wear resistance and the heat resistance for this titanium-based composite material.

However, in this case as well, the properties of the titanium-based composite materials in a high temperature range over 610° C. are not set forth at all.

⑤ In Japanese Patent Publication No. 2,523,556, there is disclosed a titanium valve, whose stem portion, fillet portion and head portion are fabricated by optimizing the hot working temperature and the heat treatment temperature.

This titanium valve obtains a desired structure by properly combining the hot working and the heat treatment. Thus, the heat resistance, etc., required for the engine valve, is satisfied.

However, the heat resistance is deficient in the high temperature range exceeding 600° C. Moreover, since the stem portion, whose fatigue strength is considered important, is fabricated by hot working at a temperature lower than the β transformation temperature, it is difficult to carry out the hot working and it lacks the mass-productivity because of the existence of the α-phase with high deformation resistance.

DISCLOSURE OF THE INVENTION

The present invention has been developed in view of the aforementioned circumstances. Namely, it is an object of the present invention to provide a titanium material, which is good in terms of the hot working property, the strength, the creep property, the fatigue property and the wear resistance.

In particular, it is an object of the present invention to provide a titanium material, which is good in terms of the heat resistance in a high temperature range exceeding 610° C., and which has not been available conventionally.

More concretely, it is an object of the present invention to produce a titanium-based composite material, which is good in terms of the hot working property, the heat resistance, the mass-productivity, and so on, and to provide a process for producing the same.

The inventors of the present invention studied earnestly in order to solve this assignment, and, as a result of a variety of systematic experiments, which were carried out repeatedly, they completed the present invention. Namely, in a titanium-based composite material, which comprised a matrix, in which a titanium alloy was a major component, and titanium compound particles or rare-earth element compound particles, which were dispersed in the matrix, the inventors of the present invention optimized the composition of the matrix and the occupying amount of the titanium compound particles or the rare-earth element compound particles, and they thus came to invent a titanium-based composite material, which was good in terms of the hot working property, the heat resistance, the mass-productivity, and so on.

Namely, a titanium-based composite material according to the present invention is characterized in that it comprises: a matrix of a titanium alloy as a major component, containing 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O); and titanium compound particles dispersed in the matrix in the amount of 1–10% by volume.

Alternatively, a titanium-based composite material according to the present invention is characterized in that it comprises: a matrix of a titanium alloy as a major component, containing 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O); and rare-earth element compound particles dispersed in the matrix in the amount of 3% by volume or less.

Further, a titanium-based composite material according to the present invention is characterized in that it comprises: a matrix of a titanium alloy as a major component, containing 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O); and titanium compound particles dispersed in the matrix in the amount of 1–10% by volume; and rare-earth element particles dispersed in the amount of 3% by volume or less.

The aluminum, the tin, the zirconium, the silicon and the oxygen, which is contained in the matrix of the present titanium-based composite material, can preferably be solved into the titanium in their total amounts to make alloys.

The titanium-based composite material according to the present invention is good in terms of the hot working property. Additionally, it is good in terms of the strength, the creep strength, the fatigue property and the wear resistance not only at room temperature but also in the elevated temperature range exceeding 610° C. It should be noted that it is good in terms of these properties in an extremely high temperature range exceeding 800° C., for example. It is not necessarily clear why these excellent properties are obtained, but it is believed as follows.

The aluminum is an element, which elevates the β transformation temperature of the titanium alloy serving as the matrix, and which enables the α phase to exist in the matrix stably up to the high temperature range. Therefore, the aluminum is an element, which improves the high temperature strength of the titanium-based composite material. Moreover, the aluminum is an element, which further improves the high temperature strength and the creep property by solving into the α phase in the matrix.

However, when the content of the aluminum is less than 3.0%, the α phase of the titanium alloy is not fully stabilized in the high temperature region. Moreover, the solving amount of the aluminum into the α phase becomes insufficient. Accordingly, the improvements of the high temperature strength and the creep property are not expected so much. While, when the content of the aluminum is exceeds 7.0% by weight, $Ti_3Al$ precipitates so that the titanium-based composite material becomes brittle.

Note that, in order to securely improve the high temperature strength and the creep property, the content of the aluminum can further preferably be 4.0–6.5% by weight.

Although both of the tin and the zirconium are neutral elements, however, similarly to the aluminum, they enable the α phase to exist stably at elevated temperatures. In addition, they can improve the high temperature strength and the creep property by solving into the α phase.

When the content of the tin is less than 2.0% by weight, the α phase does not fully stabilize up to the high temperature region, and the solving amount of the tin into the α phase becomes insufficient so that the improvements of the high temperature strength and the creep property cannot be expected so much. Moreover, when the content of the tin exceeds 6.0% by weight, since the operation, which improves the high temperature strength and the creep property of the titanium alloy, saturates, and since the density enlarges, it is not an efficient composition. In order to securely improve the high temperature strength and the creep property, the content of the tin can further preferably be 2.5–4.5% by weight.

When the content of the zirconium is less than 2.0% by weight, the α phase does not fully stabilize up to the high temperature region, and the solving amount of the zirconium into the α phase becomes insufficient. Accordingly, the improvements of the high temperature strength and the creep property cannot be expected so much. When the content of the zirconium exceeds 6.0% by weight, since the operation, which improves the high temperature strength and the creep property of the titanium alloy, saturates, it is not an efficient composition. In order to further improve the high temperature strength and the creep property, the content of the zirconium can further preferably be 2.5–4.5% by weight.

Silicon is an element, which can improve the creep property by solving into the titanium alloy. Conventionally, the anti-creep property has been secured by solving a large amount of silicon. However, when a titanium alloy containing a large amount of silicon is held at elevated temperatures for a long period of time, the silicon combines with the titanium and the zirconium to precipitate fine silicides, and the toughness thereafter was decreased at room temperature. The present titanium-based composite material can decrease the content of the silicon, which has been required conventionally to obtain a sufficient creep property, by having the titanium compound particles and the rare-earth element compound particles, which are stable at elevated temperatures.

When the content of the silicon is less than 0.1% by weight, the creep property does not improve sufficiently, when it exceeds 0.4% by weight, the high temperature strength decreases. In order to securely improve the creep property, the content of the silicon can further preferably be 0.15–0.4% by weight.

The oxygen allows the α phase to exist stably in a high temperature range by raising the β transformation temperature of the titanium alloy. Moreover, it is an element, which can improve the high temperature strength and the creep property by solving it into the α phase. When the content of the oxygen is less than 0.1% by weight, the α phase does not stabilize sufficiently, and the solving amount of the oxygen into the α phase is insufficient, the improvements of the high temperature strength and the creep property cannot be expected so much. When the content of oxygen exceeds 0.5% by weight, the titanium-based composite material is likely to be brittle. Note that, in order to allow the α phase to stably exist and in order to securely improve the high temperature strength and the creep property, the content of the oxygen can further preferably be 0.17–0.4% by weight.

In the titanium-based composite material according to the present invention, when the aluminium, the tin, the zirconium, the silicon and the oxygen, which are included in the matrix, are solved into the titanium, it is believed that alloying brings the aforementioned good operations.

While, the titanium compound particles and the rare-earth element compound particles are less likely to react with the titanium alloy, and are thermodynamically stable particles with respect to titanium alloy. Therefore, the titanium compound particles and the rare-earth element compound particles can be present stably in the titanium alloy even in a high temperature range.

Here, the titanium compound particles include titanium boride, titanium carbide, titanium nitride, or titanium silicide, and so on, for example. More concretely, the titanium compound particles may be compounds of TiB, TiC, $TiB_2$, $Ti_2C$, TiN, titanium silicide, and so on. These compound particles, when they are dispersed in the titanium-based composite material, have similar properties. And, these compound particles can be used alone, or in combination, as a reinforcement member for the titanium-based composite material.

Moreover, the rare-earth element compound particles can comprise oxides or sulfides, etc., of rare-earth elements, such as yttrium (Y), cerium (Ce), lanthanum (La), erbium (Er), or neodymium (Nd), and so on. More concretely, the rare-earth element compound particles are particles, which include a compound, such as $Y_2O_3$, etc. These particles, when they are dispersed in the titanium-based composite material, have similar properties. And, these compound particles can be used alone, or in combination, as a reinforcement member for the titanium-based composite material. Note that the titanium compound particles or the rare-earth element compound particles can contain an alloying element, which constitutes the matrix.

The titanium compounds, to begin with TiB, or the oxides or sulfides,etc., of the rare-earth element are compounds, which can stably exist in the titanium alloy up to elevated temperatures. Only the compounds, which can be stably present at elevated temperatures, can inhibit the β grain growth to improve the hot working property, and can further improve the strengths at room temperature and elevated temperatures, the creep property, the fatigue property and the wear resistance.

For instance, let us take up titanium boride particles (TiB) as an example, the titanium boride particles work effectively in the improvements of the high temperature strength and the elongation. This is also disclosed in Japanese Unexamined Patent Publication (KOKAI) No. 5-5,142, and so on. Accordingly, when the titanium boride particles are dispersed in the matrix, it is possible to improve the strength, the creep property, the fatigue property and the wear resistance of the titanium-based composite material, not only in the ordinary temperature range, but also in the high temperature range.

Here, the hot working property of the titanium-based composite material according to the present invention is remarked additionally. Usually, when a titanium alloy is heated to the complete β region and the hot working is carried out, β grain is coarsened, and cracks, etc., are likely to take place in the hot working, the limit upsetting ratio (a minimum upsetting ratio at which cracks take place by carrying out the upsetting.) decreases. With respect to this, the present titanium-based composite material has the following good characteristics.

Since the titanium compound particles or the rare-earth element compound particles are dispersed finely and uniformly in the entirety of the matrix, in the case where the hot working is carried out, the titanium compound particles and the rare-earth element compound particles effectively inhibit the β grain growth. Consequently, the titanium-based composite material according to the present invention comes to have a good hot working property, because no cracks take place even when the hot working is carried out at a temperature of the β transformation or more.

Especially, in the case where the titanium-based composite material according to the present invention is obtained by the sintering method, it is convenient, because the titanium compound particles or the rare-earth element compound particles are finely and uniformly dispersed in the matrix. And, since the titanium compound particles and the rare-earth element compound particles are hardly precipitated in the interface, the present titanium-based composite material comes to have a much better hot working property.

Of course, the production process for the titanium-based composite material according to the present invention is not limited to this. For example, there are the melting casting process, the rapid solidification process, etc. However, when the sintering process is used, it is good in all aspects, such as, the costs, the productivity, the material property, and so on.

Thus, the titanium-based composite material is preferred that the titanium compound particles and/or the rare-earth element compound particles are dispersed uniformly. Accordingly, in the case where the titanium compound particles are dispersed in the matrix, it is necessary for the titanium compound particles to occupy 1–10% by volume when the entire volume of the titanium-based composite material is taken as 100% by volume.

When the occupying content of the titanium compound particles is less than 1% by volume, the occupying content is too small, so that the titanium-based composite oxide cannot acquire the sufficient high temperature strength, the creep property, the fatigue property and the wear resistance. While, when it exceeds 10% by volume, the toughness has deteriorated.

Alternatively, in the case where the rare-earth element compound particles are dispersed in the matrix, it is necessary for the rare-earth element compound particles to occupy 3% by volume or less when the entire volume of the titanium-based composite material is taken as 100% by volume. When it exceeds 3% by volume, the toughness has deteriorated.

Hence, in the titanium-based composite material according to the present invention, the volume occupying contents of the titanium compound particles and rare-earth element compound particles are, respectively, 1 to 10% by volume and 3% by volume or less with respect to the entirety. With this arrangement, the present titanium-based composite material can fully improve the high temperature strength, the rigidity, the fatigue property, the wear resistance and the heat resistance without degrading the toughness.

Further, in order to further improve these properties, it is further preferred that the titanium compound particles are 3–7% by volume, or that the rare-earth element compound particles are 0.5–2% by volume.

As having described so far, in the titanium-based composite material according to the present invention, along with the hot working property, the superb properties can be obtained in terms of the strength, the creep property, the high-cycle fatigue property and the wear resistance. In particular, these properties are also good in a high temperature region, which exceeds 610° C.

Figure 1:
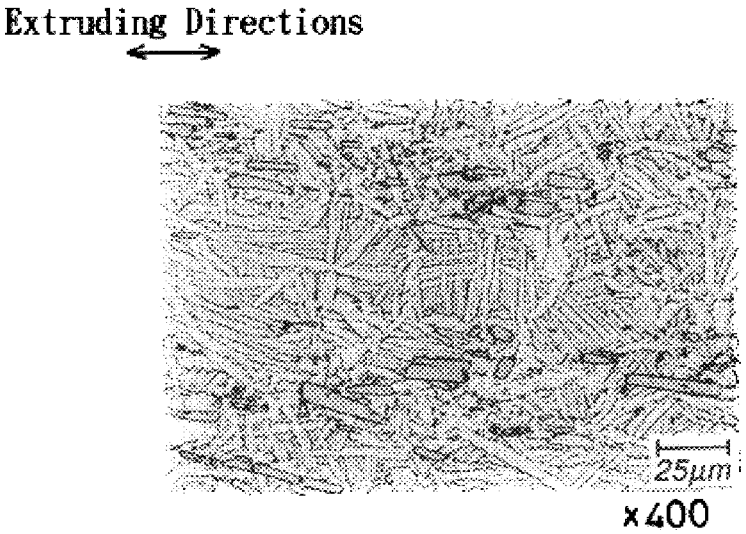
FIG. 1 is a structure of an engine valve, which was taken by an optical microscope, in Sample No. 5 of Example No. 4.

BEST MODE FOR CARRYING OUT THE INVENTION (Titanium-based Composite Material)

A titanium-based composite material according to the present invention is further preferred, supposing that the entire weight of the aforementioned titanium-based composite material is taken as 100% by weight, the titanium alloy, a major component of the matrix, further contains molybdenum (Mo) in an amount of 0.5–4.0% by weight and niobium (Nb) in an amount of 0.5–4.0% by weight.

The molybdenum is an element, which effectively stabilizes the β phase of the titanium alloy. In particular, in the case where the present titanium-based composite material is obtained by sintering, the molybdenum, in the cooling step after the sintering, has a function to finely precipitate the α phase. Namely, the molybdenum improves the strength of the titanium-based composite material at intermediate and low temperature regions, and, especially, further improves the fatigue property.

Naturally, when the content of the molybdenum is less than 0.5% by weight, it is difficult to sufficiently improve the strength of the titanium-based composite material. While, when the content of the molybdenum exceeds 4.0% by weight, the β phase increases so that the high temperature strength, the creep property and the toughness of the titanium-based composite material decrease. Note that, in order to securely improve the strength at intermediate and low temperature regions, the fatigue property, the creep property and the toughness, the content of the molybdenum can further preferably be 0.5–2.5% by weight.

Next, similar to the molybdenum, the niobium is an element, which effectively stabilizes the β phase. When the content of the niobium is less than 0.5% by weight, the high temperature strength does not improve adequately. Moreover, when the content of the niobium exceeds 4.0% by weight, the β phase increases so that the high temperature strength, the creep property and the toughness decrease. Note that, in order to securely improve the high temperature strength, the creep property and the toughness, the content of the niobium can further preferably be 0.5–1.5% by weight.

Further, both of the molybdenum and the niobium are elements, which inhibit $Ti_3Al$ from precipitating. Consequently, when these elements are contained in the titanium alloy, even if the aluminum, the tin and the zirconium are contained in the titanium alloy in large amounts, it is possible to inhibit the titanium-based composite material from becoming brittle. And, the high temperature strength and the ductility are improved in a well balanced manner, moreover, the oxidation resistance is also improved.

Furthermore, the titanium alloy, a major component of the present titanium-based composite material, is preferred when at least one metallic element selected from the group consisting of tantalum (Ta), tungsten (W) and hafnium (Hf) is used in a total amount of 5% by weight or less.

The tantalum is a β stabilizing element. A proper amount of the tantalum improves the balance between the high temperature strength and the fatigue property. When the titanium-based composite material contains the tantalum more than required, the density increases, moreover, the β phase increases, and the high temperature creep resistance decreases.

The tungsten is also a β stabilizing element. A proper amount of the tungsten improves the balance between the high temperature strength and the fatigue property. When the titanium-based composite material contains the tungsten more than required, the density increases, moreover, the β phase increases, and the high temperature creep resistance decreases.

The hafnium is a neutral element, and exhibits operations and effects similarly to the zirconium. Namely, a proper amount of the hafnium solves into the α phase so that the high temperature strength and the creep resistance of the titanium-based composite material are improved. When the titanium-based composite material contains the hafnium more than required, the density increases unpreferably.

These elements are preferred elements, which are contained additionally in the matrix. Therefore, in order not to enlarge the density of the titanium-based composite material so much while making use of the inherent properties of the matrix, the total amount of these can preferably be 5% by weight or less.

Moreover, the titanium compound particles and the rare-earth element compound particles, which are contained in the present titanium-based composite material, can further preferably exhibit an average aspect ratio of 1–40 and an average particle diameter of 0.5–50 μm.

Here, the average aspect ratio is referred to as a value, which is obtained by measuring a major diameter D1 and a minor diameter D2 of the respective particles and by averaging the ratios (D1/D2) of the all particles being subjected to the measurement. In addition, the average particle diameter is herein referred to as a diameter, which is expressed by averaging the diameters of all particles being subjected to the measurement, diameters which are exhibited by the circles whose areas are equivalent to the cross-sectional configuration of the respective particles. Note that the number of particles to be subjected to the measurements at this time was 500 to 600 pieces in both of the cases.

By making the average aspect ratio of the titanium compound particles and the rare-earth element compound particles 1–40, and by making the average particle diameter 0.5–50 μm, the hot working property of the present titanium-based composite material can be further improved. Moreover, the high temperature strength, the creep property, the fatigue property and the wear resistance can be improved.

This reason is not clear necessarily, but can be considered as follows. Here, the titanium boride particles are taken as an example, and the reasons are explained.

Figure 2:
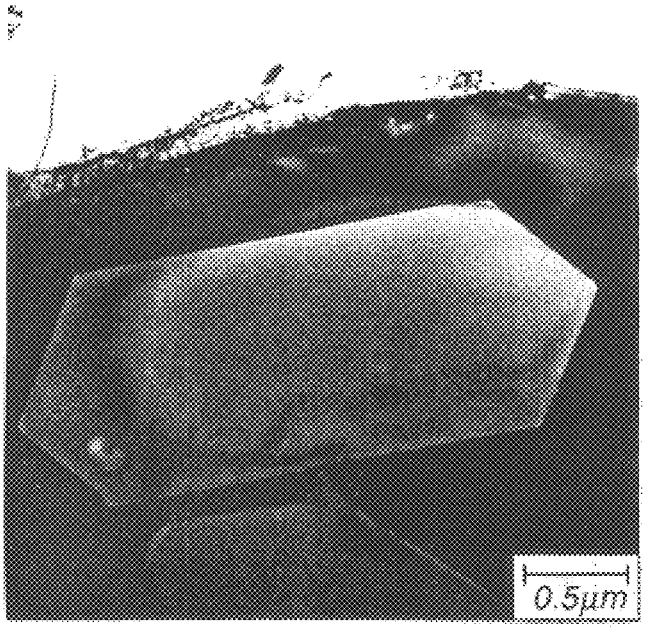
FIG. 2 is a TEM image of titanium boride particles, containing in a titanium-based composite material according to the present invention, and the interface between the matrix (titanium alloy) and the titanium boride particles.
Figure 3:
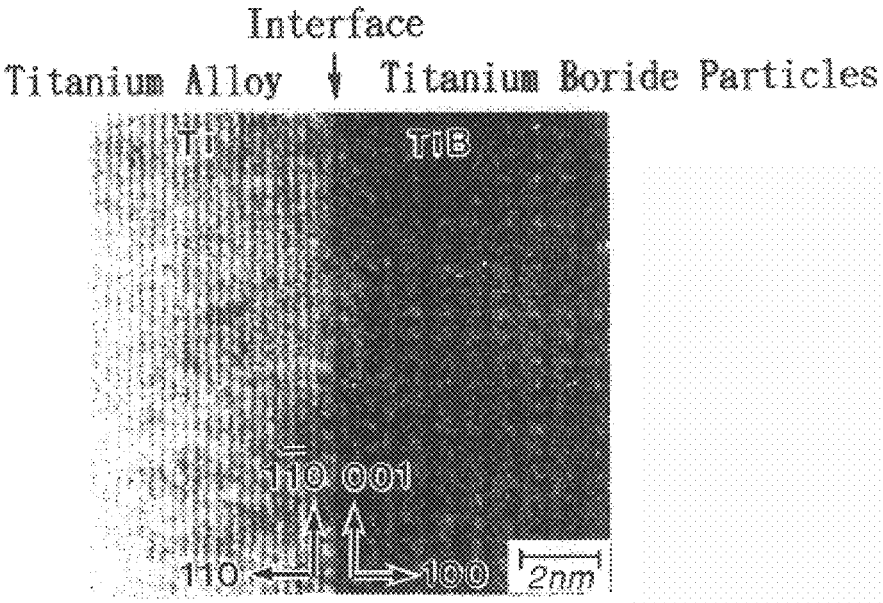
FIG. 3 is a high resolution TEM (Transmission Electron Microscope) image of the interface between the matrix (titanium alloy) and the titanium boride particles of a titanium-based composite material according to the present invention.

The mismatch at the interface between the titanium boride particles and the titanium alloy was, as illustrated in FIG. 2 and FIG. 3, 2.2% at the highest. Namely, at the interface, the coordination property is extremely high. Therefore, the interface energy between the titanium boride particles and the titanium alloy is small, when the extremely fine titanium boride particles are put even in a high temperature state, and it is difficult for them to granularly grow in the titanium alloy. Therefore, even in elevated temperature ranges, the interface structure between the titanium boride particles and the titanium alloy does not change, and the titanium-based composite material effects a high strength property.

However, when the average particle diameter of the titanium boride particles is less than 0.5 μm, this action cannot be obtained sufficiently. Moreover, when the average particle diameter exceeds 50 μm, the particle distribution becomes heterogeneous, and the particles cannot make the stress sharing uniformly. Accordingly, the destruction of the titanium-based composite material starts from the fragile matrix.

Moreover, when the average aspect ratio exceeds 40, it invites the heterogeneity in the particle distribution. Thus, the particles cannot share the stress uniformly, and the destruction of the titanium-based composite material starts from the portion of the fragile matrix. Note that, when the aspect ratio approaches as close as 1, the titanium boride particles become sphere-shaped, and it is preferred because the particles are dispersed uniformly.

So far, the titanium boride particles are taken as an example, and are described, however, the other titanium compound particles or the rare-earth element compound particles, for example, the other titanium boride particles, titanium carbide particles, titanium nitride particles or titanium silicide particles, or particles, etc., in which, as a major component, oxides or sulfides including yttrium (Y), cerium (Ce), lanthanum (La), erbium (Er) or neodymium (Nd) serve similarly.

Hence, when the titanium compound particles or the rare-earth element compound particles have an average aspect ratio of 1–40, and when they have an average particle diameter of 0.5–50 μm, the titanium-based composite material can be obtained in which the extremely fine titanium compound particles or rare-earth element compound particles are dispersed in a large amount and uniformly. The thus obtained titanium-based composite material comes to have good properties in terms of the high temperature strength, the creep resistance, the fatigue property and the wear resistance.

Note that it is furthermore preferable to make the average aspect ratio of the titanium compound particles or the rare-earth element compound 1–20 and to make the average particle diameter 0.5–30 μm because those particles are dispersed much more uniformly so that the properties of the aforementioned titanium-based composite material are furthermore enhanced.

In addition, the titanium alloy, which is the matrix of the present titanium-based composite material, can preferably comprise the β phase and the acicular α phase precipitated from the β phase.

By precipitating this acicular α phase from the β phase, it is possible to improve the high temperature creep property of the titanium-based composite material.

(Process for Producing Titanium-based Composite Material)

The production process for obtaining such a good composite material is not limited in particular. Here, as an example of the production processes, a process for producing a titanium-based composite material, the other one of the present invention, will be described.

This production process is an especially appropriate production process when producing the present titanium-based composite material.

The inventors of the present invention studied earnestly and made an effort to establish a suitable process for producing a titanium-based composite material in order to obtain the aforementioned good titanium-based composite material. Then, the inventors of the present invention thought of sintering as a production process for producing a titanium-based composite material according to the present invention. Next, the raw materials, the forming-sintering methods, and the sintering temperatures, etc., were investigated repeatedly. As a result, the inventors of the present invention confirmed that a titanium-based composite material, which was sintered at a β transformation temperature or more, and in which the α phase and the β phase were generated in a matrix, was not only good in terms of the hot working property but also in terms of the strength, the creep resistance, the fatigue property and the wear resistance. In addition, the inventors discovered that the titanium-based composite material is good in terms of such good properties not only at room temperature but also at such a high temperature beyond 610° C.

A process for producing a titanium-based composite material according to the present invention was completed based on these discoveries.

Namely, the process for producing a titanium-based composite material according to the present invention is characterized in that it is for producing a titanium-based composite material having a matrix of a titanium alloy, as a major component, containing 3.0–7.0% by weight of aluminum, 2.0–6.0% by weight of tin, 2.0–6.0% by weight of zirconium, 0.1–0.4% by weight of silicon and 0.1–0.5% by weight of oxygen; and titanium compound particles dispersed in said matrix in the amount of 1–10% by volume and/or rare-earth element compound particles dispersed therein in the amount of 3% by volume or less, and it comprises steps of: a mixing step of mixing a titanium powder, an alloy element powder containing aluminum, tin, zirconium, silicon and oxygen, and a particle element powder forming titanium compound particles and/or rare-earth element compound particles; a forming step of forming a green compact having a predetermined shape by using a mixture powder obtained in the mixing step; a sintering step of sintering the green compact obtained in the forming step at a temperature of a β transformation temperature or more, thereby generating a β phase; and a step of cooling, thereby precipitating an α phase from said β phase.

The process for producing a titanium-based composite material according to the present invention comprises a series of steps, the mixing step, the forming step, the sintering step and the cooling step. The respective steps can be carried out in the following manner.

(1) Mixing Process

The mixing process first prepares a titanium powder, an alloy element powder containing aluminum, tin, zirconium, silicon and oxygen, and a particle element powder forming titanium compound particles and/or rare-earth element compound particles.

① Titanium Powder

As for the titanium powder, for example, it is possible to use a powder such as a sponge titanium powder, a hydride-dehydride titanium powder, a titanium hydride powder, an atomized powder, etc. The configuration and the particle diameter (particle diameter distribution) of the constituent particles of the titanium powder are not limited in particular. Since a commercially available titanium powder is often adjusted so that it exhibits about 150 μm (#100) or less and about 100 μm or less by average particle diameter, it can be used as it is. Moreover, when a titanium powder is used, which has 45 μm (#325) or less and the average particle diameter of about 20 μm or less, it is easy to obtain a dense sintered body.

Note that, in view of the costs and the denseness, it is desirable that the average particle diameter of the titanium powder is 10–200 μm.

② Alloy Element Powder

The alloy element powder is a necessary powder, which is needed to obtain the titanium alloy being a major component of the matrix. Since the titanium alloy contains, in addition to titanium, aluminum, tin, zirconium, silicon and oxygen, the alloy element powder, for example, can comprise the simple substances (metallic simple substances) of aluminium, tin, zirconium, silicon, or can comprise the compounds or the alloy powders, etc., of aluminum, tin, zirconium, silicon and oxygen. It can be the alloys or the powders, which can be made from one of the respective elements or the combinations. Moreover, it can be the powders of the alloys or the compounds, which can be made from titanium and one of the respective elements or the combinations. The composition of the alloy element powder is prepared properly according to the compounding amount of the matrix.

Further, an alloy powder, which has all of aluminum, tin, zirconium, silicon and oxygen in the composition, can be made as the alloy element powder. Furthermore, a compound powder and a metal (a simple substance or alloy) powder can be combined to make an alloy element powder. For instance, it is possible to mix an aluminum compound powder with an alloy powder, which has tin, zirconium, silicon and oxygen in the composition.

③ Particle Element Powder

The particle element powder is required to form the titanium compound particles or the rare-earth element compound particles. The particle element powder can be the powders of titanium compounds or rare-earth element compounds as they are. Further, it can be a powder of the simple substances, alloys or compounds of boron, carbon, nitrogen, silicon, or the rare-earth elements, and so on, which form the titanium compound particles or the rare-earth element compound particles, by reacting with a component element of the matrix (titanium, oxygen, etc.). Furthermore, it can be the combinations of such many kinds of powders.

Here, as for the titanium compound particles, for instance, there are titanium boride particles, titanium carbide particles, titanium nitride particles, titanium silicide particles, and so on. As for the titanium compound particles, they can be not only one member of these, but also the combinations of these. As for the rare-earth element compound particles, there are oxides or sulfides, etc., of yttrium (Y), cerium (Ce), lanthanum (La), erbium (Er) or neodymium (Nd). The rare-earth element compound particles can be not only one member of these, but also they can be combined. Moreover, a powder of these titanium compound particles and a powder of these rare-earth element compound particles can be composited so that they can make a particle element powder.

Here, as an example of the particle element powder, a representative titanium boride powder will be explained. The titanium boride powder has titanium boride ($TiB_2$, etc.) as a major component. This titanium boride powder can contain the alloying elements of the matrix. For example, the titanium boride powder can comprise a powder of a compound, an alloy, and the like, of aluminum, tin, zirconium, silicon or oxygen, and a powder of a compound, an alloy, and so on, of boron.

The boron in this titanium boride powder reacts with titanium to form titanium boride particles in the sintering step later described. Moreover, when an alloy or a compound contains boron in the alloy element powder, it is convenient because it is not necessary to separately prepare the titanium boride powder.

Note that the configuration, the diameter (particle diameter distribution), etc., of the particles, which constitute the alloy element powder and the particle element powder, are not limited in particular, however, it is further proper when the average particle diameter of the alloy element powder is 5–200 $\mu$m, and when the average particle diameter of the particle element powder is 1–30 $\mu$m, because the titanium-based composite material having a uniform structure can be obtained.

In the case where a powder having a comparatively large diameter is available, it can be adjusted to a desired particle size with a variety of pulverizers, such as a ball mill, a vibration mill, an attritor, etc.

④ Mixing

The thus prepared titanium powder, alloy element powder and particle element powder are mixed. The mixing method can be mixed with a V-type mixer, a ball mill and a vibration mill, etc., however, it is not limited to these particularly. In this step, a known mixing method is employed, no special measures are taken, and a mixed powder, in which the respective powder particles are dispersed uniformly, can be obtained. Therefore, this process can be accomplished very inexpensively.

However, in the case where the alloy element powder or the particle element powder is particles, which agglomerate the secondary particles, and so on, vigorously, it is preferable to carry out stirring and mixing with a high energy ball mill, such as an attritor, etc., in an inert gas atmosphere. By carrying out such a process, it is possible to further densify the titanium-based composite material.

(2) Forming Step

The forming step is a step, in which a green compact having a predetermined configuration is made by using the mixture powder obtained in the aforementioned mixing step. This predetermined configuration can be a final configuration of an intended article, and in the case where a processing is carried out after the sintering step, it can be a billet shape.

As for the forming method in this forming step, it is possible to use the die forming, the CIP forming (Cold Isostatic Press Forming), the RIP forming (Rubber Isostatic Press Forming), and so on. Of course, it is not limited to these, the other known powder forming methods can be utilized. Note that, when the die forming, the CIP, the RIP, etc., are used, these forming pressures, and so on, are adjusted so that desired mechanical properties can be obtained.

(3) Sintering Step

The sintering step is a step, in which the green compact obtained in the forming step is sintered at a temperature of the β transformation temperature or more. Namely, by this sintering step, the respective particles, which contact in the green compact, are sintered with each other. In this sintering, the following occur.

When the green compact is heated to the β transformation temperature or more, the titanium powder and the alloy element powder are alloyed to form a titanium alloy, which is a matrix. Simultaneously therewith, between the titanium powder and the particle element powder, new compounds (for instance, TiB, etc.) are formed.

By sintering such a green compact, in the matrix whose major component is the titanium alloy, the titanium-based composite material, in which the titanium compound particles and/or rare-earth element compounds are dispersed, is formed.

The sintering in the sintering step can preferably be carried out in vacuum or in an inert gas atmosphere. Further, the sintering temperature is carried out in the temperature range of the β transformation temperature or more, and the temperature range can further preferably be 1,200° C.–1,400° C. Furthermore, the sintering time can preferably be 2–16 hours. In the sintering carried out at less than 1,200° C. or for less than 2 hours, the densifying is not necessarily sufficient. In the sintering carried out at a temperature exceeding 1,400° C. or for 16 hours or more, it is not economical energetically, and is not efficient in terms of the productivity.

Hence, it is preferred that the sintering is carried out under the conditions at 1,200° C.–1,400° C. for 2–6 hours so as to obtain the titanium-based composite material having a desirable structure.

Note that, in the case where the titanium alloy, the major component of the matrix, contains niobium, molybdenum, tantalum, tungsten and hafnium in addition to aluminum, tin, zirconium, silicon and oxygen, the aforementioned production process can be utilized similarly.

Namely, a powder containing these respective elements is prepared in advance, and this powder is used as the alloy element powder in the mixing step. With this arrangement, it is possible to readily contain niobium, molybdenum, tantalum, tungsten and hafnium in the matrix. In this case as well, the powder of the simple substance (metal), the alloy or the compound of the respective elements, aluminum, tin, zirconium, silicon, oxygen, niobium, molybdenum, tantalum, tungsten and hafnium, can be prepared so that the respective elements are contained in the predetermined amounts, respectively.

Moreover, when a particle element powder, which contains the titanium compound particles and/or the rare-earth element compound particles having an average aspect ratio of 1–40 and an average particle diameter of 0.5–50 $\mu$m is used, mixed and sintered, it is possible to uniformly disperse such titanium compound particles and/or rare-earth element compound particles in the matrix by a solid phase reaction with ease.

(4) Cooling Step

The cooling step is a step, which precipitates the acicular $\alpha$ phase from the $\beta$ phase after the sintering step. By finely disperse the $\alpha$ phase in the $\beta$ phase, namely, by the precipitation reinforcement, it is possible to remarkably improve the strength of the titanium-based composite material.

Concretely, by cooling it at a desired cooling rate after the sintering, it is possible to precipitate the acicular $\alpha$ phase from the $\beta$ phase. This cooling rate can preferably be 0.1–10° C./s approximately. Especially, it is further preferred that the cooling rate is 1° C./s. Moreover, as for the cooling method, there are the cooling in a furnace cooling, the controlled cooling, etc. As for the controlled cooling, there are forced cooling by an inert gas, such as an argon gas, cooling by controlling a voltage of a furnace, and so on, the cooling rate is controlled by these.

Here, while taking a titanium-based composite material, which employs a titanium compound powder (a kind of the particle element powder) containing a $TiB_2$ powder, as an example, the cooling step is explained. After the sintering step, a 2-phase structure is obtained, which is composed of the $\beta$ phase of the titanium alloy and the TiB particles (titanium compound particles). When this is cooled at the aforementioned cooling rate, the needle-shaped $\alpha$ phase precipitates from the $\beta$ phase.

As a result, there is formed a mixture phase of the $\beta$ phase and the acicular $\alpha$ phase. This mixture phase of the $\beta$ phase, the acicular $\alpha$ phase and the TiB particles improves the creep property and the fatigue property of the titanium-based composite material at an elevated temperature range. Note that, when the titanium-based composite material is subjected to hot working, these TiB particles effectively inhibit the $\beta$ grain growth.

The aforementioned steps can use readily available raw material powders and existing facilities. In addition, the man-hour requirements are less, and the respective steps are simple. Accordingly, this production process is especially suitable to obtain the titanium-based composite material according to the present invention.

Conventionally, it has been very difficult to obtain a titanium material, which is good in terms of the hot working property, the high temperature strength, the creep resistance, the fatigue property and the wear resistance, etc. Therefore, the productivity of such a titanium material has been poor considerably, and its use has been limited in the special fields.

As having described so far, the titanium-based composite material and the production process according to the present invention have successfully solved this assignment.

(Application Example of the Present Production Process)

It has been mentioned earlier that the titanium-based composite material according to the present invention is appropriate for automotive engine valves. These automotive engine valves can be easily produced by the production process for the titanium-based composite material according to the present invention. In this case, by forming the green compact into a desired valve configuration in the forming step, the producing of the automotive engine valves becomes further easy.

Next, taking the producing an automotive engine valve as an example, the process for producing a titanium-based composite material according to the present invention will be described in detail.

① In the forming step, a billet of a suitable configuration is made. Thereafter, the green compact is sintered in the sintering step. Then, the resulting sintered billet is subjected to a hot working step, in which it is hot worked into a valve shape at a temperature in the $\alpha+\beta$ range or of the $\beta$ transformation temperature or more.

The sintered billet, which is obtained by the production process for a titanium-based composite material according to the present invention, has a mixture phase of the $\beta$ phase, the acicular $\alpha$ phase and the titanium compound particles and/or the rare-earth element compound particles, such as TiB particles, and so on. Consequently, even when it is hot worked in the $\alpha+\beta$ range or at the $\beta$ transformation temperature or more, it exhibits a low deformation resistance, and is good in terms of the hot working property. In this case, it is preferable because the hot working can be easily carried out by using existing facilities.

Here, the sintered billet exhibits a favorable hot working property because the $\beta$ grains are inhibited from growing abnormally by the TiB particles, and so on (Specifically, the $\beta$ particle diameter can be controlled to 50 $\mu$m or less by average.) when it is heated at the $\beta$ transformation temperature or more, and accordingly it is possible to hot work at the $\beta$ transformation temperature or more. Namely, since it is possible to hot work at the $\beta$ transformation temperature or more, a sound workpiece can be obtained which exhibits a low deformation resistance, which inhibits the abnormal $\beta$ grain growth, and which is free from the wrinkles and cracks.

② In the hot working step, it is further preferable to carry out the following.

First, the sintered billet is hot-extruded at a temperature in the $\alpha+\beta$ range or of the $\beta$ transformation temperature or more, thereby forming a stem portion having a desired configuration. Next, at a temperature in the $\alpha+\beta$ range or the $\beta$ transformation temperature or more, a head portion having a desired configuration is made by upset forging. At this time, the stem portion and the head portion can be processed integrally to make an engine valve workpiece, or this stem portion and the head portion can be bonded by welding, etc., to make an engine valve workpiece. Thereafter, this workpiece can be subjected to a finish processing, and thereby it can make an engine valve having desired specifications.

At this time, the processing temperature in forming the stem portion and the head portion can preferably fall in the range of 900° C.–1,200° C. for both of them. When the processing temperature is less than 900° C., it is difficult to fully decrease the deformation resistance. While, when the processing temperature exceeds 1,200° C., there arise probabilities that the oxidation takes place vigorously, that the material properties thereafter are adversely affected, and that the fine cracks occur in the surface during the hot working.

③ Moreover, when the configuration of the green compact is further approximated to a desired valve configuration in the forming step, it is preferable because it is easier to carry out the hot working. Thus, the present production process is especially suitable for producing an engine valve, which comprises the titanium-based composite material according to the present invention. In addition, it is possible to mass-produce an engine valve, which is good in terms of the high temperature strength, the specific strength, and so on, and it is possible to inexpensively obtain such an engine valve.

Hereinafter, while reciting specific examples and comparative examples, the present invention will be described in detail.

EXAMPLES

Example No. 1: Sample No. 1

① As raw material powders, a commercially available hydride-dehydride titanium powder (# 100), an alloy element powder (an average particle diameter: 9 μm: the values are % by weight of the constituent elements (being the same hereinafter unless otherwise specified)) comprising an alloy powder having a composition of 42.1Al—28.4Sn—27.8Zr—1.7Si, and a $TiB_2$ powder (an average particle diameter: 2 μm) serving as the particle element powder were prepared, respectively. Note that, by properly selecting and using titanium powders whose oxygen contents were different, the oxygen contents of the matrix were adjusted. This was the same in respective examples and comparative examples hereinafter described. For instance, titanium powders containing oxygen in an amount of 0.1–0.35% by weight were used, however, oxygen was contained slightly in the alloy element powder (0.1% by weight approximately).

These raw material powders were compounded in a ratio, and were mixed well by an attritor (mixing step). By using the thus obtained mixture powder, a cylinder-shaped (ϕ16×32 mm) billet was made by forming with a die (forming step). Here, the forming pressure was 6 t/cm $^2$.

Subsequently, by heating this billet in a vacuum of $1\times10^{-5}$ torr, it was heated at a temperature increment rate of 12.5° C./min (similarly in the examples and comparative examples below) from room temperature to a sintering temperature of 1,300° C., and it was held at the sintering temperature for 4 hours to sinter (sintering step). Thereafter, it was cooled at a cooling rate of 1° C./s (cooling step). From the thus obtained sintered billet, a sample for measurements (Sample No. 1), which was used in the following measurements, was obtained.

On Sample No. 1, by using a scanning electron microscope (SEM: Scanning Electron Microscope) and a wet-type analyzing apparatus, the composition of the matrix and the occupying amounts of the titanium boride particles (TiB particles) were measured. The results of their measurements are set forth in Table 1.

Note that, the contents of the respective elements of aluminum, tin, zirconium, silicon, oxygen, niobium and molybdenum were the values when the weight of the total sample was taken as 100% by weight, and that the occupying amount of the titanium boride particles was the value when the volume of the total sample was taken as 100% by volume. This is the same in the examples and the comparative examples below.

Moreover, as a result of a measurement on the relative density of Sample No. 1 with respect to the true density thereof by the Archimedes method, it was found that the relative density was 98.5%. From this, it was understood that Sample No. 1 was good in terms of the denseness.

② While, by using the aforementioned mixture powder, a valve was produced in the following manner.

Figure 5A:
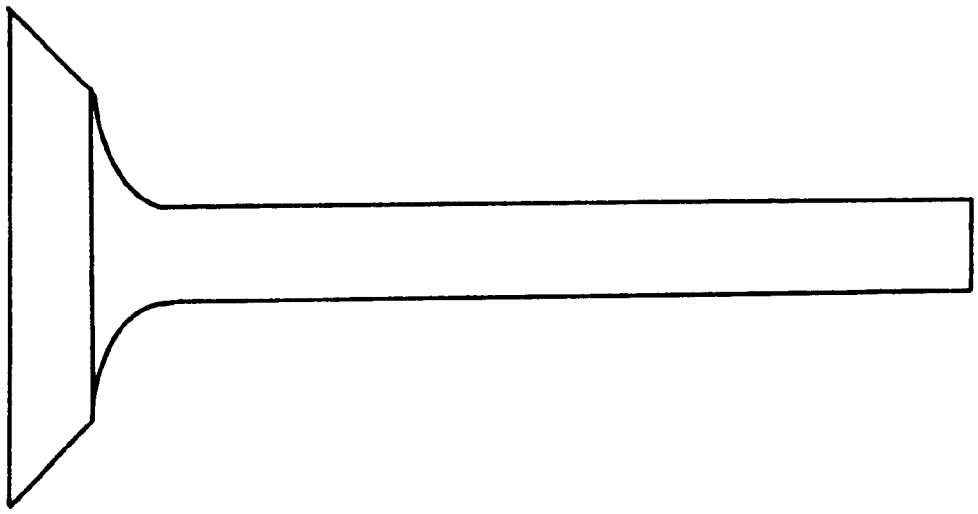
FIG. 5A is a diagram for illustrating a configuration of a valve-shaped green compact, which was produced in Example No. 1.
Figure 5B:
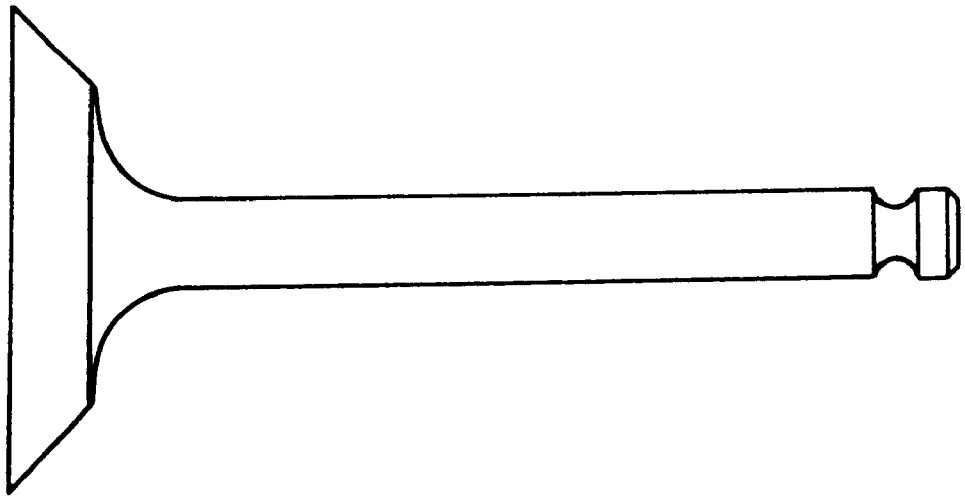
FIG. 5B is a diagram for illustrating a configuration of an engine valve, which was produced in Example No. 1.

The mixture powder was made by CIP forming at 4 t/cm$^2$, and a valve-shaped green compact having a shape of 8 mm (stem diameter)×35 mm (head diameter)×120 mm (entire length) was obtained. The configuration of this valve-shaped green compact is illustrated in FIG. 5A. Subsequently, the sintering of this valve-shaped green compact was carried out in a vacuum of $1\times10^{-5}$ torr at 1,300° C. for 16 hours, and the cooling was carried out. Then, this sintered substance was finish-processed to a desired shape, thereby obtaining an engine valve. The configuration of this engine valve is illustrated in FIG. 5B. This engine valve was subjected to an actual machine durability test, and was evaluated.

Example No. 2: Sample No. 2

① As raw material powders, a commercially available sponge titanium powder (# 100), an alloy element powder (an average particle diameter: 9 μm) comprising an alloy powder having a composition of 36.9Al—24.9Sn—24.4Zr—6.2Nb—6.2Mo—1.4Si, and a $TiB_2$ powder (an average particle diameter: 2 μm) serving as the particle element powder were prepared, respectively. These raw material powders were compounded in a ratio, respectively, and were mixed well by an attritor (mixing step). By using the thus obtained mixture powder, a green compact having a predetermined configuration was made by CIP forming. Here, the forming pressure was 4 t/cm $^2$.

Subsequently, by heating this green compact in a vacuum of $1\times10^{-5}$ torr, it was heated at the aforementioned temperature increment rate of 12.5° C./min from room temperature to the sintering temperature of 1,300° C., and it was held at the sintering temperature for 16 hours to sinter (sintering step). Thereafter, it was cooled at the aforementioned cooling rate of 1° C./s (cooling step). From the thus obtained sintered billet, a sample for measurements (Sample No. 2), which was used in the following measurements, was obtained.

On Sample No. 2, similarly to Example No. 1, the composition of the matrix and the occupying amount of the titanium boride particles were measured. The results of their measurements are set forth in Table 1.

Moreover, the measurement of the relative density of Sample No. 2 with respect to the true density thereof was measured in the same manner as Sample No. 1, as a result, it was found that the relative density was 98.5%. From this, it was understood that Sample No. 2 was good in terms of the denseness.

② While, by using the aforementioned mixture powder, a valve was produced in the same manner as Example No. 1.

Example No. 3: Sample No. 3

① As raw material powders, a commercially available hydride-dehydride titanium powder (# 100), an alloy element powder (an average particle diameter: 9 μm)comprising an alloy powder having a composition of 36.9Al—24.9Sn—24.4Zr—6.2Nb—6.2Mo—1.4Si, and a $TiB_2$ powder (an average particle diameter: 2 μm) serving as the particle element powder were prepared, respectively. These raw material powders were compounded in a ratio, and were mixed well by an attritor (mixing step). By using the thus obtained mixture powder, a cylinder-shaped (ϕ16×32 mm) billet was made by forming with a die (forming step). Here, the forming pressure was 6 t/cm $^2$. Subsequently, by heating this billet in a vacuum of $1\times10^{-5}$ torr, it was heated at the aforementioned temperature increment rate of 12.5° C./min from room temperature to the sintering temperature of 1,300° C., and it was held at the sintering temperature for 4 hours (sintering step). Thereafter, it was cooled at the aforementioned cooling rate of 1° C. Is (cooling step). From the thus obtained sintered billet, a sample for measurements (Sample No. 3), which was used in the following measurements, was obtained.

On Sample No. 3, similarly to Example No. 1, the composition of the matrix and the occupying amount of the titanium boride particles were measured. The results of their measurements are set forth in Table 1.

Moreover, the measurement of the relative density of Sample No. 3 with respect to the true density thereof was measured in the same manner as Sample No. 1, as a result, it was found that the relative density was 98.5%. From this, it was understood that Sample No. 3 was also good in terms of the denseness.

② While, by using the aforementioned mixture powder, a valve was produced in the same manner as Example No 1.

Example No. 4: Sample Nos. 4–9

① As raw material powders, a commercially available hydride-dehydride titanium powder (# 100), an alloy element powder (an average particle diameter: 9 μm)including an alloy powder having a composition of 36.9Al—24.9Sn—24.4Zr—6.2Nb—6.2Mo—1.4Si, and a $TiB_2$ powder (an average particle diameter: 2 μm) serving as the particle element powder were prepared, respectively. These raw material powders were compounded in a ratio, respectively, and were mixed well by an attritor (mixing step).

Note that, in this example, 6 kinds of the mixture powders were prepared whose compounding ratios were different. By using the thus obtained 6 kinds of the mixture powders were used respectively and independently, 6 kinds of cylinder-shaped (ϕ 16×32) green compact were made by forming with a die (forming step). Here, the forming pressure was 6 t/cm 2 in each of them.

Subsequently, by heating these green compacts in a vacuum of $1\times10^{-5}$ torr, they were heated at the aforementioned temperature increment rate of 12.5° C./min from room temperature to the aforementioned sintering temperature of 1,300° C., and they were held at the sintering temperature for 4 hours to sinter (sintering step). Thereafter, it was cooled at the aforementioned cooling rate of 1° C./s (cooling step). From the thus obtained sintered substances, samples for measurements (Sample No. 4–Sample No. 9), which were used in the following measurements, were obtained, respectively.

On Sample No. 4–Sample No. 9, similarly to Example No. 1, the compositions of the matrices of the respective samples and the occupying amounts of the titanium boride particles were measured, respectively. The results of their measurements are set forth in Table 1. Note that, in Sample No. 5, it was found that the average aspect ratio of the titanium boride particles was 35, and that the average particle diameter was 2 μm.

Moreover, the measurements on the relative densities of Sample No. 4–Sample No. 9 with respect to the true densities thereof were measured in the same manner as Example No. 1, as a result, it was found that the relative density was 98.5% in each of the samples. From this, it was understood that Sample No. 4–Sample No. 9 were good in terms of the denseness.

② By using the respective sintered billets of the aforementioned Sample Nos. 5 and 9, stem portions were made at 1,150° C. by hot-extrusion processing, respectively. Subsequently, the rest of the portions were heated to 1,150° C., and the head portions were made by forging, respectively. This valve-shaped substance had the same configuration as the valve-shaped substance of Example No. 1 shown in FIG. 5A.

Regarding the stem portion of the engine valve, which comprised the sintered billet obtained from Sample No. 5, a cross-sectional structure in the extrusion directions is illustrated in FIG. 1. According to FIG. 1, it was understood that this structure showed a structure, in which the titanium boride particles were oriented in the extrusion directions in the α+β phase of the matrix.

Example No. 5: Sample No. 10

① As raw material powders, a commercially available hydride-dehydride titanium powder (# 100), an alloy element powder (an average particle diameter: 3 μm) comprising an alloy powder having a composition of 33.0Al—22.OSn—22.0Zr—22.0Mo—1.0Si, and a $TiB_2$ powder (an average particle diameter: 2 μm) serving as the particle element powder were prepared, respectively. These raw material powders were compounded in a ratio, respectively, and were mixed well, thereby obtaining a mixture powder (mixing step). The thus obtained mixture powder was made as a cylinder shape (ϕ 16×32) by forming with a die (forming step). Here, the forming pressure was 6 t/cm$^2$.

Subsequently, by heating this green compact in a vacuum of $1\times10^{-5}$ torr, it was heated at the aforementioned temperature increment rate of 12.5° C./min from room temperature to the sintering temperature of 1,300° C., and it was held at the sintering temperature for 4 hours to sinter (sintering step). Thereafter, it was cooled at the aforementioned cooling rate of 1° C./s (cooling step). From the thus obtained sintered substance, a sample for measurements (Sample No. 10), which was used in the following measurements, was obtained.

On Sample No. 10, similarly to Example No. 1, the composition of the matrix and the occupying amount of the titanium boride particles were measured. The results of their measurements are set forth in Table 1.

Moreover, the measurement of the relative density of Sample No. 10 with respect to the true density thereof was measured in the same manner as Sample No. 1, as a result, it was found that the relative density was 98.5%. From this, it was understood that Sample No. 10 was also good in terms of the denseness.

② By using the aforementioned sintered billet, a stem portion was made at 1,150° C. by hot-extrusion processing.

Example No. 6: Sample No. 11

① As raw material powders, a commercially available hydride-dehydride titanium powder (ϕ 100), an alloy element powder (an average particle diameter: 9 μm) comprising an alloy powder having a composition of 36.9Al—24.9Sn—24.4Zr—6.2Nb—6.2Mo—1.4Si, and a TiC powder (an average particle diameter: 3 μm) serving as the particle element powder were prepared, respectively. These raw material powders were compounded in a ratio, respectively, and were mixed well, thereby obtaining a mixture powder (mixing step). This mixture powder was made as a cylinder shape (ϕ 16×32) by forming with a mold (forming step). Here, the forming pressure was 6 t/cm$^2$.

Subsequently, by heating this green compact in a vacuum of $1\times10^{-5}$ torr, it was heated at the aforementioned temperature increment rate of 12.5° C./min from room temperature to the sintering temperature of 1,300° C., and it was held at the sintering temperature for 4 hours to sinter (sintering step). Thereafter, it was cooled at the aforementioned cooling rate of 1° C./s (cooling step). From the thus obtained sintered billet, a sample for measurements (Sample No. 11), which was used in the following measurements, was obtained.

On Sample No. 11, similarly to Example No. 1, the composition of the matrix and the occupying amount of the titanium carbide particles (TiC) were measured. The results of the measurements are set forth in Table 1.

Moreover, the measurement of the relative density of Sample No. 11 with respect to the true density thereof was measured in the same manner as Sample No. 1, as a result, it was found that the relative density was 98.5%. From this, it was understood that Sample No. 11 was also good in terms of the denseness.

② By using the aforementioned sintered billet, an engine valve was produced in the same manner as Sample No. 5 of Example No. 4, and was subjected to a durability test.

Example No. 7: Sample No. 12

① As raw material powders, a commercially available hydride-dehydride titanium powder (ϕ 100), an alloy element powder (an average particle diameter: 9 μm) comprising an alloy powder having a composition of 36.9Al—24.9Sn—24.4Zr—6.2Nb—6.2Mo—1.4Si, and a TiC powder (an average particle diameter: 3 μm) and a $TiB_2$ powder (an average particle diameter: 3 μm) serving as the particle element powder were prepared, respectively. These raw material powders were compounded in a ratio, respectively, and were mixed well, thereby obtaining a mixture powder (mixing step). This mixture powder was made as a cylinder shape (ϕ 16×32) by forming with a die (forming step). Here, the forming pressure was 6 t/cm$^2$.

Subsequently, by heating this green compact in a vacuum of $1\times10^{-5}$ torr, it was heated at the aforementioned temperature increment rate of 12.5° C./min from room temperature to the sintering temperature of 1,300° C., and it was held at the sintering temperature for 4 hours to sinter (sintering step). Thereafter, it was cooled at the aforementioned cooling rate of 1° C. Is (cooling step). From the thus obtained sintered billet, a sample for measurements (Sample No. 12), which was used in the following measurements, was obtained.

On Sample No. 12, similarly to Example No. 1, the composition of the matrix and the occupying amounts of the titanium carbide particles and the titanium boride particles were measured. The results of the measurements are set forth in Table 1.

Moreover, the measurement of the relative density of Sample No. 12 with respect to the true density thereof was measured in the same manner as Sample No. 1, as a result, it was found that the relative density was 98.5%. From this, it was understood that Sample No. 12 was also good in terms of the denseness.

② By using the aforementioned sintered billet, a stem portion was made at 1,150° C. by hot-extrusion processing.

Example No. 8: Sample No. 13

① As raw material powders, a commercially available hydride-dehydride titanium powder (ϕ 100), an alloy element powder (an average particle diameter: 9 μm) comprising an alloy powder having a composition of 36.9Al—24.9Sn—24.4Zr—6.2Nb—6.2Mo—1.4Si, an alloy element powder comprising a tantalum powder (an average particle diameter: 9 μm) and a tungsten powder (an average particle diameter: 3 μm), and a $TiB_2$ powder serving as the particle element powder were prepared, respectively. These raw material powders were compounded in a ratio, respectively, and were mixed well, thereby obtaining a mixture powder (mixing step). This mixture powder was made as a cylinder shape (ϕ 16×32) by forming with a die (forming step). Here, the forming pressure was 6 t/cm$^2$.

Subsequently, by heating this green compact in a vacuum of $1\times10^{-5}$ torr, it was heated at the aforementioned temperature increment rate of 12.5° C./min from room temperature to the sintering temperature of 1,300° C., and it was held at the sintering temperature for 4 hours to sinter (sintering step). Thereafter, it was cooled at the aforementioned cooling rate of 1° C./s (cooling step). From the thus obtained sintered billet, a sample for measurements (Sample No. 13), which was used in the following measurements, was obtained.

On Sample No. 13, similarly to Example No. 1, the composition of the matrix and the occupying amount of the titanium boride particles were measured. The results of the measurements are set forth in Table 1.

Moreover, the measurement of the relative density of Sample No. 13 with respect to the true density thereof was measured in the same manner as Sample No. 1, as a result, it was found that the relative density was 98.5%. From this, it was understood that Sample No. 13 was also good in terms of the denseness.

② By using the aforementioned sintered billet, a stem portion was made at 1,150° C. by hot-extrusion processing.

Example No. 9: Sample No. 14

① As raw material powders, a commercially available hydride-dehydride titanium powder (ϕ 100), an alloy element powder (an average particle diameter: 9 μm) comprising an alloy powder having a composition of 30.7Al—24.9Sn—24.4Zr—6.2Nb—6.2Mo—6.2Hf—1.4Si, and a $Y_2O_3$ powder (an average particle diameter: 3 μm) and a $TiB_2$ powder (an average particle diameter: 2 μm) serving as the particle element powder were prepared, respectively. These raw material powders were compounded in a ratio, respectively, and were mixed well, thereby obtaining a mixture powder (mixing step). This mixture powder was made as a cylinder shape (ϕ 16×32) by forming with a die (forming step). Here, the forming pressure was 6 t/cm$^2$.

Subsequently, by heating this green compact in a vacuum of $1\times10^{-5}$ a torr, it was heated at the aforementioned temperature increment rate of 12.5° C./min from room temperature to the sintering temperature of 1,300° C., and it was held at the sintering temperature for 4 hours to sinter (sintering step). Thereafter, it was cooled at the aforementioned cooling rate of 1° C./s (cooling step). From the thus obtained sintered billet, a sample for measurements (Sample No. 14), which was used in the following measurements, was obtained.

On Sample No. 14, similarly to Example No. 1, the composition of the matrix and the occupying amount of the titanium boride particles were measured. The results of the measurements are set forth in Table 1. Note that the occupying amount of the $Y_2O_3$ particles were about 0.8% by volume.

Moreover, the measurement of the relative density of Sample No. 14 with respect to the true density thereof was measured in the same manner as Sample No. 1, as a result, it was found that the relative density was 98.5%. From this, it was understood that Sample No. 14 was also good in terms of the denseness.

② By using the aforementioned sintered substance, a stem portion was made at 1,150° C. by hot-extrusion processing.

TABLE 1

| Example | Sample No. | Matrix Composition (% by weight) Al | Sn | Zr | Si | O | Mo | Nb | Ta | W | Hf | Y | Occupying Amount of Particles (% by Volume) Titanium Boride | Titanium Carbide |
|---|---|---|---|---|---|---|---|---|---|---|---|---|---|---|
| 1 | 1 | 5.90 | 3.90 | 3.90 | 0.14 | 0.30 | — | — | — | — | — | — | 5 | — |
| 2 | 2 | 6.2 | 4.3 | 4.4 | 0.18 | 0.33 | 1.15 | 0.96 | — | — | — | — | 9 | — |
| 3 | 3 | 6.6 | 4.6 | 4.6 | 0.2 | 0.35 | 1.10 | 0.9 | — | — | — | — | 10 | — |
| | 4 | 4.49 | 3.29 | 3.03 | 0.11 | 0.36 | 0.76 | 0.81 | — | — | — | — | 5 | — |
| | 5 | 5.74 | 3.94 | 3.90 | 0.14 | 0.32 | 0.98 | 1.03 | — | — | — | — | 5 | — |
| 4 | 6 | 6.31 | 4.30 | 4.31 | 0.16 | 0.31 | 1.08 | 1.13 | — | — | — | — | 5 | — |
| | 7 | 5.57 | 3.92 | 3.91 | 0.14 | 0.32 | 0.99 | 1.03 | — | — | — | — | 1 | — |
| | 8 | 5.71 | 3.91 | 3.90 | 0.14 | 0.37 | 0.98 | 1.03 | — | — | — | — | 3 | — |
| | 9 | 5.67 | 3.90 | 3.86 | 0.16 | 0.34 | 0.97 | 1.01 | — | — | — | — | 10 | — |
| 5 | 10 | 5.84 | 3.84 | 4.00 | 0.15 | 0.17 | 3.77 | — | — | — | — | — | 5 | — |
| 6 | 11 | 5.92 | 4.02 | 3.94 | 0.12 | 0.35 | 1.02 | 1.10 | — | — | — | — | — | 5 |
| 7 | 12 | 5.78 | 3.89 | 3.91 | 0.14 | 0.27 | 0.97 | 0.89 | — | — | — | — | 3 | 2 |
| 8 | 13 | 5.71 | 3.95 | 3.87 | 0.13 | 0.31 | 0.89 | 0.88 | 2.01 | 1.05 | — | — | 5 | — |
| 9 | 14 | 5.81 | 3.78 | 3.86 | 0.11 | 0.29 | 0.99 | 0.98 | — | — | 3.78 | 0.50 | 5 | — |

Comparative Examples

Comparative Example No. 1: Sample No. C1

① As raw material powders, a commercially available hydride-dehydride titanium powder (# 100), an Al—-40V powder (an average particle diameter: 3 μm), and a $TiB_2$ powder (an average particle diameter: 2 μm) were prepared, respectively. These raw material powders were compounded in a ratio, and were mixed well by an attritor. By using the thus obtained mixture powder, a cylinder-shaped substance (ϕ 16×32) was made by forming with a mold. Here, the forming pressure was 6 t/cm$^2$.

Subsequently, by heating this green compact in a vacuum of $1\times10^{-5}$ torr, it was heated at the aforementioned temperature increment rate of 12.5° C./min from room temperature to the sintering temperature of 1,300° C., and it was held at the sintering temperature for 4 hours to sinter. Thereafter, it was cooled at the aforementioned cooling rate of 1° C./s. From the thus obtained sintered billet, a sample for measurements (Sample No. C1), which was used in the following measurements, was obtained.

On Sample No. C1, similarly to Example No. 1, the composition of the matrix and the occupying amount of the titanium boride particles were measured. The results of these measurements are set forth in Table 2.

Moreover, the measurement of the relative density of Sample No. C1 with respect to the true density thereof was measured in the same manner as Sample No. 1, as a result, it was found that the relative density was 96.5%.

② By using the aforementioned sintered billet, a stem portion was made at 1,150° C. by hot extrusion processing in the same manner as Example No. 5. Subsequently, the rest of the portion was heated to 1,150° C., and the head portion was made by upset forging. By processing this, similarly to Example No. 1, an engine valve illustrated in FIG. 5B was produced. Note that, in the comparative example, there arose cracks after the extrusion.

Comparative Example No. 2: Sample No. C2

① As raw material powders, a commercially available hydride-dehydride titanium powder (# 100), an alloy powder (an average particle diameter: 3 μm) having a composition of 36.9Al—24.9Sn—24.4Zr—6.2Nb—6.2Mo—1.4Si, and a $TiB_2$ powder (an average particle diameter: 2 μm) were prepared, respectively. These raw material powders were compounded in a ratio, and were mixed well by an attritor. By using the thus obtained mixture powder, a cylinder-shaped (ϕ 16×32) green compact was made by forming with a die. Here, the forming pressure was 6 t/cm$^2$.

Subsequently, by heating this green compact in a vacuum of $1\times10^{-5}$ torr, it was heated at the aforementioned temperature increment rate of 12.5° C./min from room temperature to the sintering temperature of 1,300° C., and it was held at the sintering temperature for 4 hours to sinter. It was cooled at the aforementioned cooling rate of 1° C./s. From the thus obtained sintered billet, a sample for measurements (Sample No. C2), which was used in the following measurements, was obtained.

On Sample No. C2, similarly to Example No. 1, the composition of the matrix and the occupying amount of the titanium boride particles were measured. The results of their measurements are set forth in Table 2. Note that, in Sample No. C2, it was found that the average aspect ratio of the titanium boride particles was 52, and that the average particle diameter was 55 μm.

② By using the aforementioned sintered billet, similarly to Comparative Example No. 1, an engine valve was produced.

Comparative Example No. 3: Sample No. C3

① As raw material powders, a commercially available hydride-dehydride titanium powder (ϕ 100), and an alloy powder (an average particle diameter: 3 μm) having a composition of 36.9Al—24.9Sn—24.4Zr—6.2Nb—6.2Mo—1.4Si were prepared, respectively. These raw material powders were compounded in a ratio, and were mixed well by an attritor. By using the thus obtained mixture powder, a cylinder-shaped (ϕ 16×32) green compact was made by forming with a die. Here, the forming pressure was 6 t/cm$^2$.

Subsequently, by heating these green compacts in a vacuum of $1\times10^{-5}$ torr, they were heated at the aforementioned temperature increment rate of 12.5° C./min from room temperature to the sintering temperature of 1,300° C., and they were held at the sintering temperature for 4 hours to sinter. Thereafter, they were cooled at the aforementioned cooling rate of 1° C./s. From the thus obtained sintered billets, a sample for measurements (Sample No. C3), which was used in the following measurements, was obtained.

On Sample No. C3, similarly to Example No. 1, the composition of the matrix and the occupying amount of the titanium boride particles were measured. The results of their measurements are set forth in Table 2.

Moreover, the measurement of the relative density of Sample No. C3 with respect to the true density thereof was measured in the same manner as Sample No. 1, as a result, it was found that the relative density was 99%.

② By using the aforementioned sintered billet, similarly to Comparative Example No. 1, an engine valve was produced.

Comparative Example No. 4: Sample No. C4

① As raw material powders, a commercially available hydride-dehydride titanium powder (ϕ 100), and an alloy powder (an average particle diameter: 3 μm) having a composition of 36.9Al—24.9Sn—24.4Zr—6.2Nb—6.2Mo—1.4Si, and a $TiB_2$ powder (an average particle diameter: 2 μm) were prepared, respectively. These raw material powders were compounded in a ratio, and were mixed well by an attritor. By using the thus obtained mixture powder, a cylinder-shaped (ϕ 16×32) green compact was made by forming with a die. Here, the forming pressure was 6 t/cm$^2$.

Subsequently, by heating these green compacts in a vacuum of $1\times10^{-5}$ torr, they were heated at the aforementioned temperature increment rate of 12.5° C./min from room temperature to the sintering temperature of 1,300° C., and they were held at the sintering temperature for 4 hours to sinter. Thereafter, they were cooled at the aforementioned cooling rate of 1° C./s. From the thus obtained sintered billets, a sample for measurements (Sample No. C4), which was used in the following measurements, was obtained.

On Sample No. C4, similarly to Example No. 1, the composition of the matrix and the occupying amount of the titanium boride particles were measured. The results of their measurements are set forth in Table 2.

Moreover, the measurement of the relative density of Sample No. C4 with respect to the true density thereof was measured in the same manner as Sample No. 1, as a result, it was found that the relative density was 96.5%. Similarly to Sample No. C1 in above-described Comparative Example No. 1, the cracks took place after the extrusion. From these, it was understood that, when the occupying amount of the titanium boride particles exceeded 10% by volume, the cracks were promoted in the extrusion, and that the ductility was degraded.

② By using the aforementioned sintered billet, similarly to Comparative Example No. 1, an engine valve was produced.

Comparative Example No. 5: Sample Nos. C5, C6

① An ingot forging heat-resistant titanium alloy (TIMETAL-1100) was prepared, and was labeled as Sample No. C5. In Table 2, an alloy composition of Sample No. C5 is shown.

On Sample No. C5, it was heated at 1,050° C. to carry out a solution treatment, and was thereafter subjected to an annealing treatment at 950° C.

② By using this titanium material, an engine valve, which had the same configuration as that of Example No. 1, was produced.

③ An ingot forging heat-resistant titanium alloy (TIMETAL-834) was prepared, and was labeled as Sample No. C6.

Regarding Sample No. C6, it was heated at 1,027° C. to carry out a solution treatment, and was subjected to an aging treatment at 700° C.

Comparative Example No. 6: Sample Nos. C7

① A heat-resistant steel (SUH35) was prepared, and was labeled as Sample No. C7. In Table 2, an alloy composition thereof is shown.

② By using this heat-resistant steel, an engine valve, which had the same configuration as that of Example No. 1, was produced.

TABLE 2

| Comp. Ex. | Sample No. | Matrix Composition (% by weight) | | | | | | | | | Occupying Amount of Titanium Boride Particles (% by Volume) |
|---|---|---|---|---|---|---|---|---|---|---|---|
| | | Al | V | Sn | Zr | Si | O | Mo | Nb | C | |
| 1 | C1 | 6.0 | 4.0 | — | — | — | — | — | — | — | 15 |
| 2 | C2 | 5.85 | — | 3.91 | 3.87 | 0.15 | 0.35 | 1.06 | 1.03 | — | 5 |
| 3 | C3 | 5.74 | — | 3.92 | 3.91 | 0.14 | 0.32 | 0.99 | 1.03 | — | — |
| 4 | C4 | 5.74 | — | 3.92 | 3.91 | 0.14 | 0.32 | 0.99 | 1.03 | — | 15 |
| 5 | C5 | 6.0 | — | 2.75 | 4.0 | 0.45 | 0.07 | 0.4 | — | — | — |
| | C6 | 5.8 | — | 4.0 | 3.5 | 0.35 | 0.1 | 0.5 | 0.7 | 0.006 | — |
| 6 | C7 | Fe—2.09Cr—9.0Mn—3.8Ni—0.12Nb (0.48C, 0.37N, 0.1Mo, 0.1V, 0.1W) | | | | | | | | | — |

[Strength, Creep Property, Fatigue Property and Wear Resistance]

On the respective samples or the engine valves, which were obtained in the above-described examples and comparative examples, the following tests were carried out respectively in order to evaluate the room temperature strength, the high temperature strength exceeding 610° C., the creep property, the fatigue property and the wear resistance.

Regarding the strengths, a tensile test was first carried out while the samples were at room temperature, and the values of the tensile strength, the 0.2% proof stress and the elongation were measured, respectively. Next, a tensile test was carried out while the samples were heated to 800° C., and the values of the 0.2% proof stress were measured. These results are set forth in Table 3 and Table 4. Note that the tensile test at room temperature was carried out by using an Instron tensile testing machine R.T. at a straining rate of $4.55\times10^{-4}$/s. Moreover, the tensile test at an elevated temperature was carried out at 800° C. at a straining rate of 0.1/s.

TABLE 3

| Example | Sample No. | 0.2% P.S.*1 at R.T.*2 (MPa) | 0.2% P.S.*1 at 800° C. (MPa) | Elongation (%) | W.R.*3 | D.*4 on A.V.*5 |
|---|---|---|---|---|---|---|
| 1 | 1 | 1096 | 435 | 3.0 | ○ | ○ |
| 2 | 2 | 1127 | 515 | 1.2 | ○ | ○ |
| 3 | 3 | 1200 | 510 | 1.1 | ○ | ○ |
| | 4 | 1186 | 416 | 10.5 | ○ | — |
| | 5 | 1274 | 541 | 5.2 | ○ | ○ |
| 4 | 6 | 1283 | 582 | 2.1 | ○ | — |
| | 7 | 1205 | 430 | 10.0 | ○ | — |
| | 8 | 1245 | 465 | 5.9 | ○ | — |
| | 9 | 1310 | 550 | 2.0 | ○ | ○ |
| 5 | 10 | 1274 | 400 | 2.5 | — | — |
| 6 | 11 | 1268 | 487 | 3.8 | ○ | ○ |
| 7 | 12 | 1271 | 520 | 4.8 | ○ | — |
| 8 | 13 | 1254 | 505 | 3.9 | ○ | — |
| 9 | 14 | 1244 | 474 | 2.9 | ○ | — |

Notes:
*1stands for Proof Stress.
*2stands for Room Temperature.
*3stands for Wear Resistance.
*4stands for Durability.
*5stands for Actual Vehicle.

TABLE 4

| Comp. Ex. | Sample No. | 0.2% P.S.*1 at R.T.*2 (MPa) | 0.2% P.S.*1 at 800° C. (MPa) | Elongation (%) | W.R.*3 | D.*4 on A.V.*5 |
|---|---|---|---|---|---|---|
| 1 | C1 | 1020 | 250 | 0.3 | x | x |
| 2 | C2 | 1100 | 520 | 0.8 | x | x |
| 3 | C3 | 1135 | 372 | 10.0 | x | x |
| 4 | C4 | 1050 | 595 | 0.2 | — | x |
| 5 | C5 | 900 | 350 | 2.0 | x | x |
| | C6 | 890 | 345 | 4.5 | — | — |
| 6 | C7 | 920 | 400 | 25 | ○ | ○ |

Notes:
*1stands for Proof Stress.
*2stands for Room Temperature.
*3stands for Wear Resistance.
*4stands for Durability.
*5stands for Actual Vehicle.

The following are understood from Table 3 and Table 4.

① Tensile Strength

The 0.2% proof stresses at room temperature were not differed greatly between Sample Nos. 1–10 of the Examples and Sample Nos. C1–C6 of the Comparative Examples.

However, on the 0.2% proof stress at 800° C., Sample Nos. 1–9 exhibited higher values than Sample Nos. C1, C3, C5 and C6.

Especially, concerning 0.2% proof stress, many of Sample Nos. 2–9 exhibited higher values than Sample No. 1. This is believed that the matrices of the respective samples of Sample Nos. 2–9 contained molybdenum in an amount of 0.5–4.0% by weight and niobium in an amount of 0.5–4.0% by weight.

Moreover, regarding Sample Nos. 11–14, they had a high temperature strength of 400 MPa or more, and secured an enough strength property as a valve material.

② Creep Property

Figure 4:
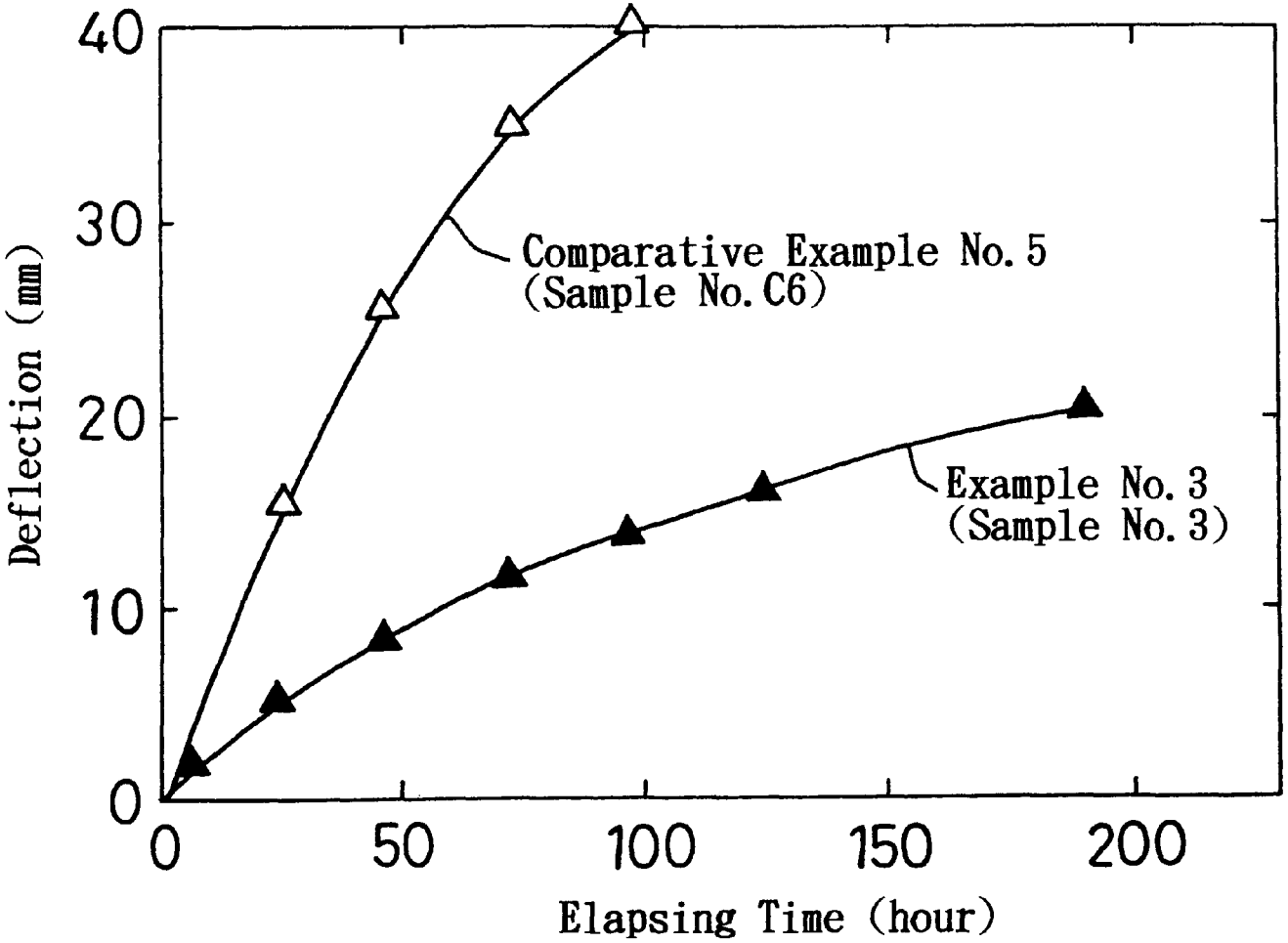
FIG. 4 is a graph for illustrating creep properties (the relationships between elapsing times and creep deflections) on samples, an example (Sample No. 3) and a comparative example (Sample No. C6), at 800° C.

In a dry air, the samples, which were heated at a temperature of 800° C., were subjected to a creep test, in which a bending stress of 50 MPa was applied to them, thereby evaluating the creep property by measuring the creep deflections with respect to the elapsing times, and the creep property was evaluated. In FIG. 4, there are set forth the results of the measurements on Example No. 3 (Sample No. 3) and. Comparative Example No. 5 (Sample No. C6). From FIG. 4, it was understood that Sample No. 3 surpassed Sample No. C6 in terms of the creep property at 800° C.

Moreover, although not illustrated herein, it was understood all of other Sample Nos. 1–9 were superior in terms of the creep property.

③ Fatigue Property

In air and at room temperature, a rotary bending fatigue test was carried out, thereby evaluating the fatigue property at room temperature. As a result, in a sample (Sample No. 5) of Example No. 4, a fatigue property of $10^7$ times at about 750 MPa was obtained. While, in a sample (Sample No. C2) of Comparative Example No. 2, a fatigue property of $10^7$ times at 480 MPa was obtained. From these, it was understood that Example No. 4 of the present invention was excellent in terms of the fatigue strength at room temperature.

Moreover, by heating them to a temperature of 850° C. in air and by carrying out a rotating bending test, the fatigue property at the high temperature was thereby evaluated. As a result, in a sample (Sample No. 5) of Example No. 4, a fatigue property of $10^7$ times at about 175 MPa was obtained, in a sample (Sample No. C2) of Comparative Example No. 2, a fatigue property of $10^7$ times at about 120 MPa was obtained, in a sample (Sample No. C5) of Comparative Example No. 5, a fatigue property of $10^7$ times at about 100 MPa was obtained, and, in a sample (Sample No. C7) of Comparative Example No. 6, a fatigue property of $10^7$ times at about 150 MPa was obtained. From these, it was understood that Example No. 4 of the present invention also surpassed in terms of the fatigue strength at the elevated temperature.

④ Wear Resistance

The wear resistance was evaluated by the pin-on-disk test. In this test, when the pin wear amount was resulted in 3 mg/2×$10^3$ m or less, the wear resistance was supposed to be good, and ○ was marked in Table 3 and Table 4. Moreover, when the pin wear amount was resulted in 10 mg/2×$10^3$ m or more, the wear resistance was supposed to be inferior, and X was marked in Table 3 and Table 4. As set forth in Table 3 and Table 4, it was understood that all of the samples of the examples were good in terms of the wear resistance.

⑤ Durability

Regarding the engine valves, which were made by the sintered billets of Example No. 4 (Sample No. 5) and Comparative Example No. 3 (Sample No. C3), an on-engine-bench full-load and high-speed durability test (the actual vehicle durability test) was carried out. And, the wear amounts of the engine valves, which had been after the test, were measured at the respective portions, thereby evaluating the durability of the wear resistance. Note that the actual vehicle durability test was carried out under the testing conditions of average 7,000 rpm×200 hr.

In this actual vehicle durability test, when it was a predetermined standard wear amount or less, the durability was supposed to be good, and ○ was marked in Table 3 and Table 4. While, when it exceeded the predetermined wear amount or when it resulted in axial elongation or breakage, the durability of the wear resistance was supposed to be inferior, and X was marked in Table 3 and Table 4.

As set forth in Table 3, it was understood that all of the samples of the present examples were good in terms of the durability of the wear resistance. This was believed that, since the titanium boride particles were dispersed finely and uniformly in the samples of the present examples, the agglomeration wear was less likely to take place.

[On Dispersion Particles in Matrix]

The titanium-based composite material according to the present invention has been investigated from the various aspects as described above, as a result, the following were further clarified on the particles to be dispersed in the matrix. Namely, all of the titanium compound particles and the rare-earth element compound particles, which were dispersed in the present titanium-based composite material, were effective in improving the heat resistance, etc., of the titanium material, however, it was found that the TiB particles were particularly effective in the improvement of the heat resistance of the titanium-based composite material.

① For example, when comparing the sample (Sample No. 5) of the aforementioned Example No. 4 and the sample (Sample No. 11) of Example No. 6, Sample No. 11 contained aluminum, which is an a -stabilizing element of titanium alloys, more than Sample No. 5. Accordingly, it has been normally believed that Sample No. 11 would exhibit the high temperature proof stress larger than that of Sample No. 5. However, as can be seen from Table 3, Sample No. 5 actually exhibited the larger high temperature proof stress. Besides, Sample No. 5 was superb in terms of the room temperature proof stress.

Here, when comparing the both of the samples, the compositions of the both of them do not differ so largely except the aluminum. Therefore, it was believed that the difference between the particles dispersed in the matrix: namely; the difference between the TiB particles dispersed in Sample No. 5 and the TiC particles dispersed in Sample No. 11 resulted in that Sample No. 5 had better properties than Sample No. 11. In other words, in view of the balance of strength-ductility of the titanium-based composite material, the TiB particles were superior to the TiC particles as particles dispersed in the matrix.

Accordingly, the reason was investigated by taking up 3 kinds of titanium compound particles, TiB particles, TiC particles and TiN particles. The properties of the respective particles are recited in Table 5. From this Table 5, the following were understood, for example.

When examining the mutual solid solubility of these reinforcement particles with the matrix, which effects the balance between the strength and the ductility of the titanium-based composite material, the mutual solid solubility between the TiB particles and the titanium comprising the matrix, was remarkably smaller than the TiC particles and the TiN particles. Due to this, it was understood that the TiB particles were very stable particles in titanium alloys. Thus, it was believed that the TiB particles fully effected the properties of its own without embrittling the matrix, and that they reinforced the titanium-based composite material substantially according to the rule of mixtures. While, since the TiC particles were solved into the matrix a little, the room temperature ductility of the titanium-based composite material decreased more or less, compared with the TiB particles.

② Although the rare-earth element compound particles, similar to the TiB particles, were also stable in titanium alloys, the density of the sintered substance decreased when they were added more than 3% by volume. Accordingly, as aforementioned, in the titanium-based composite material according to the present invention, it is effective to adjust the dispersing amount of the rare-earth element compound to 3% by volume or less.

However, in view of this sintering ability as well, the titanium compound particles, particularly the TiB particles, are much more effective, because they can be dispersed in the matrix in a large amount.

③ Of course, although the rare-earth element compound particles and the titanium compound particles, such as the TiB particles, and so on, are different in terms of their chemical properties, it is common in both of them which are good in terms of the stability, etc., in titanium alloys, and they are not different in that they can improve the heat resistance, and the like, of titanium alloys. Therefore, not only when the TiB particles are used, but also when the titanium-based composite material, in which the titanium compound particles, such as the TiC particles, and so on, or the rare-earth element compound particles are dispersed, are used in an engine valve, and the like, for instance, it is possible to obtain a lightweight engine valve which is good in terms of the heat resistance, the durability, etc., and it is convenient.

TABLE 5

| Particles | Hardness (GPa) | Young's Modulus (GPa) | Linear Expansion Coefficient ($\times 10^{-6}$/K) | Max. Solving Amount (at %) *1 | Max. Solving Amount (at %) *2 |
|---|---|---|---|---|---|
| TiB | 28.0 | 550 | 8.6 | <0.001 | 1.0 |
| TiC | 24.7 | 460 | 7.4 | 1.2 | 15.0 |
| TiN | 24.0 | 250 | 9.3 | 22.0 | 26.0 |

Notes:
*1 means the solving amounts of boron, carbon and nitrogen into the matrix.
*2 means the solving amount of titanium into the particles.
(Reference) The linear expansion coefficient of titanium alloy is approximately $9 \times 10^{-6}$/K.

Since the titanium-based composite material according to the present invention exhibits the aforementioned excellent properties, it can be used as automotive engine component parts, a variety of leisure or sport articles, tools, etc. Especially, in accordance with the present titanium-based composite material, even at the extremely high temperature as high as 800° C., it is possible to obtain the superb strength, creep property, fatigue property and wear resistance. Accordingly, it is a suitable material for automotive engine valves, for example. In particular, it is further suitable for component parts, such as exhaust valves, which are used at elevated temperatures (for instance, at around 800° C.), and which are required to exhibit the specific strength, the fatigue resistance, and so on.

We claim:

1. A titanium-based composite material comprising: a matrix of a titanium alloy as a major component, comprising 3.0–7.0% by weight of aluminum (Al), 2.0–6.0% by weight of tin (Sn), 2.0–6.0% by weight of zirconium (Zr), 0.1–0.4% by weight of silicon (Si) and 0.15–0.5% by weight of oxygen (O); and titanium compound particles dispersed in the matrix in the amount of 1–10% by volume.

2. A titanium-based composite material characterized in that it comprises: a matrix of a titanium alloy as a major component, containing 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O); and rare-earth element compound particles dispersed in the matrix in the amount of 3% by volume or less.

3. A titanium-based composite material characterized in that it comprises: a matrix of a titanium alloy as a major component, containing 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O);

titanium compound particles dispersed in the matrix in the amount of 1–10% by volume; and rare-earth element compound particles dispersed therein in the amount of 3% by volume or less.

4. The titanium-based composite material according to claim 1, wherein said matrix contains said aluminum in an amount of 4.0–6.5% by weight.

5. The titanium-based composite material according to claim 1, wherein said matrix contains said tin in an amount of 2.5–4.5% by weight.

6. The titanium-based composite material according to claim 1, wherein said matrix contains said zirconium in an amount of 2.5–4.5% by weight.

7. The titanium-based composite material according to claim 1, wherein said matrix contains said silicon in an amount of 0.15–0.4% by weight.

8. A titanium-based composite material comprising: a matrix of a titanium alloy as a major component, comprising 3.0–7.0% by weight of aluminum (Al), 2.0–6.0% by weight of tin (Sn), 2.0–6.0% by weight of zirconium (Zr), 0.1–0.4% by weight of silicon (Si); and titanium compound particles dispersed in the matrix in the amount of 1–10% by volume, wherein said matrix contains oxygen in an amount/of0.15–0.4% by weight.

9. The titanium-based composite material according to claim 1, wherein said matrix further comprises molybdenum (Mo) in an amount of 0.5–4.0% by weight and niobium (Nb) in an amount of 0.15–4.0% by weight.

10. The titanium-based composite material according to claim 9, wherein said matrix contains said molybdenum in an amount of 0.5–2.5% by weight.

11. The titanium-based composite material according to claim 9, wherein said matrix contains said niobium in an amount of 0.5–1.5% by weight.

12. The titanium-based composite material according to claim 8, wherein said matrix further comprises at least one metallic element selected from the group consisting of tantalum (Ta), tungsten (W) and hafnium (Hf) in a total amount of 5% by weight or less.

13. The titanium-based composite material according to claim 3, wherein said titanium compound particles are at least one member selected from the group consisting of titanium boride, titanium carbide, titanium nitride and titanium silicide; and said rare-earth element compound particles are at least one member selected from the group consisting of oxides and sulfides of yttrium (Y), cerium (Ce), lanthanum (La), erbium (Er) and neodymium (Nd).

14. The titanium-based composite material according to claim 13, wherein said titanium compound particles are TiB and/or TiC, and said rare-earth element compound particles $Y_2O_3$.

15. The titanium-based composite material according to claim 3, wherein said titanium compound particles and/or said rare-earth element compound particles have an average aspect ratio of 1–40, and have an average particle diameter of 0.5–50 $\mu$m.

16. The titanium-based composite material according to claim 1 which exhibits a 0.2% proof stress of 400 MPa or more at 800° C. or more.

17. A process for producing a titanium-based composite material having a matrix of a titanium alloy as a major component, containing 3.0–7.0% by weight of aluminum, 2.0–6.0% by weight of tin, 2.0–6.0% by weight of zirconium, 0.1–0.4% by weight of silicon and 0.1–0.5% by weight of oxygen; and titanium compound particles dispersed in the matrix in the amount of 1–10% by volume and/or rare-earth element compound particles dispersed therein in the amount of 3% by volume or less, the process characterized by comprising the steps of:

a mixing step of mixing a titanium powder, an alloy element powder containing aluminum, tin, zirconium, silicon and oxygen, and a particle element powder forming the titanium compound particles and/or the rare-earth element compound particles;

a forming step of forming a green compact having a predetermined shape by using a mixture powder obtained in the mixing step;

a sintering step of sintering the green compact obtained in the forming step at a temperature of a β transformation temperature or more to generate a β phase; and a step of cooling to precipitate an α phase from said β phase.

18. The process for producing a titanium-based composite material according to claim 17, wherein said sintering temperature is adjusted to 1,200–1,400° C.; and the sintering time is adjusted to 2–16 hours.

19. The process for producing a titanium-based composite material according to claim 17, wherein said cooling step is carried out at the cooling rate of 0.1–10 (°C./s).

20. The process for producing a titanium-based composite material according to claim 17, wherein said mixing step is carried out by mixing said titanium powder having an average particle diameter of 10–200 μm, said alloy element powder having an average particle diameter of 5–200 μm, and said particle element powder having an average particle diameter of 1–30 μm.

21. An engine valve comprising a titanium-based composite material, said composite material comprising: a matrix of a titanium alloy as a major component, comprising 3.0–7.0% by weight of aluminum (Al), 2.0–6.0% by weight of tin (Sn), 2.0–6.0% by weight of zirconium (Zr), 0.1–0.4% by weight of silicon (Si) and 0.15–0.5% by weight of oxygen (O); and titanium compound particles dispersed in the matrix in the amount of 1–10% by volume or less.

22. An engine valve comprising a titanium-based composite material, said composite material comprising: a matrix of a titanium alloy as a major component, comprising 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O); and rare-earth element compound particles dispersed in the matrix in the amount of 3% by volume or less.

23. An engine valve comprising a titanium-based composite material, said composite material comprising: a matrix of a titanium alloy as a major component, comprising 3.0–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O); and titanium compound particles dispersed in the matrix in the amount of 1–10% by volume and rare-earth element compound particles dispersed therein in the amount of 3% by volume or less.

24. The titanium-based composite material according to claim 1, wherein said titanium compound particles are at least one member selected from the group consisting of titanium boride, titanium carbide, titanium nitride and titanium silicide.

25. The titanium-based composite material according to claim 24, wherein said titanium compound particles are TiB and/or TiC.

26. A titanium-based composite material comprising: a matrix of a titanium alloy as a major component, comprising 3.07–7.0% by weight of aluminum (Al), 2.0–6.0% by weight of tin (Sn), 2.0–6.0% by weight of zirconium (Zr), 0.1–0.4% by weight of silicon (Si) and 0.1–0.5% by weight of oxygen (O); and titanium compound particles dispersed in the matrix in the amount of 1–10% by volume, whereins said titanuium compound particles have an average aspect ratio of 1–40%, and have an average particle diameter of 0.5–50 μm.

27. The titanium-based composite material according to claim 2, wherein said rare-earth element compound particles are at least one member selected from the group consisting of oxides and sulfides of yttrium (Y), cerium (Ce), lanthanum (La), erbium (Er) and neodymium (Nd).

28. The titanium-based composite material according to claim 27, wherein said rare-earth element compound particles are $Y_2O_3$.

29. The titanium-based composite material according to claim 2, wherein said rare-earth element compound particles have an average aspect ratio of 1–40, and have an average particle diameter of 0.5–50 μm.

30. A composite comprising a titanium alloy having titanium compound particles dispersed therein in an amount of 1–10% by volume, wherein said titanium alloy comprises titanium, 3–7% by weight aluminum, 2–6% by weight tin, 2–6% by weight zirconium, 0.1–0.4% by weight silicon and 0.15–0.5% by weight oxygen.

31. A composite comprising a titanium alloy having rare-earth element compound particles dispersed therein in an amount of 3% by volume or less, wherein said titanium alloy comprises titanium, 3–7% by weight aluminum, 2–6% by weight tin, 2–6% by weight zirconium, 0.1–0.4% by weight silicon and 0.1–0.5% by weight oxygen.

32. A composite comprising a titanium alloy having titanium compound particles dispersed therein in an amount of 1–10% by volume and rare-earth element compound particles dispersed therein in an amount of 3% by volume or less, wherein said titanium alloy comprises titanium, 3–7% by weight aluminum, 2–6% by weight tin, 2–6% by weight zirconium, 0.1–0.4% by weight silicon and 0.1–0.5% by weight oxygen.

33. The composite according to claim 30, wherein said titanium compound particles are at least one member selected from the group consisting of titanium boride, titanium carbide, titanium nitride and titanium silicide.

34. The composite according to claim 30, wherein said titanium compound particles are TiB and/or TiC.

35. A composite comprising a titanium alloy having titanium compound particles dispersed therein in an amount of 1–10% by volume, wherein said titanium alloy comprises titanium, 3–7% by weight aluminum, 2–6% by weight tin, 2–6% by weight zirconium, 0.1–0.4% by weight silicon and 0.1–0.5% by weight oxygen, wherein said titanium compound particles have an average aspect ratio of 1–40, and have an average particle diameter of 0.5–50 μm.

36. The composite according to claim 31, wherein said rare-earth element compound particles are at least one member selected from the group consisting of oxides and sulfides of yttrium (Y), cerium (Ce), lanthanum (La), erbium (Er) and neodymium (Nd).

37. The composite according to claim 31, wherein said rare-earth element compound particles are $Y_2O_3$.

38. The composite according to claim 31, wherein said rare-earth element compound particles have an average aspect ratio of 1–40, and have an average particle diameter of 0.5–50 μm.

39. The composite according to claim 32, wherein said titanium compound particles are at least one member selected from the group consisting of titanium boride, titanium carbide, titanium nitride and titanium silicide.

40. The composite according to claim 32, wherein said titanium compound particles are TiB and/or TiC.

41. The composite according to claim 32, wherein said titanium compound particles have an average aspect ratio of 1–40, and have an average particle diameter of 0.5–50 $\mu$m.

42. The composite according to claim 32, wherein said rare-earth element compound particles are at least one member selected from the group consisting of oxides and sulfides of yttrium (Y), cerium (Ce), lanthanum (La), erbium (Er) and neodymium (Nd).

43. The composite according to claim 32, wherein said rare-earth element compound particles are $Y_2O_3$.

44. The composite according to claim 32, wherein said rare-earth element compound particles have an average aspect ratio of 1–40, and have an average particle diameter of 0.5–50 $\mu$m.

45. The composite according to claim 42, wherein said titanium compound particles are at least one member selected from the group consisting of titanium boride, titanium carbide, titanium nitride and titanium silicide.

46. The composite according to claim 43, wherein said titanium compound particles are TiB and/or TiC.

47. The composite according to claim 46, wherein said titanium compound particles have an average aspect ratio of 1–40, and have an average particle diameter of 0.5–50 $\mu$m.

48. The composite according to claim 47, wherein said rare-earth element compound particles have an average aspect ratio of 1–40, and have an average particle diameter of 0.5–50 $\mu$m.

* * * * *

UNITED STATES PATENT AND TRADEMARK OFFICE

CERTIFICATE OF CORRECTION

PATENT NO. : 6,551,371 B1
DATED : April 22, 2003
INVENTOR(S) : Tadahiko Furuta et al.

It is certified that error appears in the above-identified patent and that said Letters Patent is hereby corrected as shown below:

Column 32,
Line 22, delete "amount/of0.15-0.4%" and insert -- amount/of 0.15-0.4% --;
Line 26, delete "0.15" and insert -- 0.5 --

Column 33,
Line 64, delete "3.07" and insert -- 3.0 --;

Column 34,
Line 4, delete "1-40%" and insert -- 1-40, --

Signed and Sealed this

Twenty-eighth Day of October, 2003

JAMES E. ROGAN
*Director of the United States Patent and Trademark Office*